US010479087B2

(12) United States Patent
Tamenaga et al.

(10) Patent No.: US 10,479,087 B2
(45) Date of Patent: Nov. 19, 2019

(54) LIQUID EJECTION HEAD, LIQUID EJECTION APPARATUS, AND LIQUID EJECTION HEAD MANUFACTURE METHOD

(71) Applicant: CANON KABUSHIKI KAISHA, Tokyo (JP)

(72) Inventors: Zentaro Tamenaga, Sagamihara (JP); Shuzo Iwanaga, Kawasaki (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/598,677

(22) Filed: May 18, 2017

(65) Prior Publication Data

US 2017/0341398 A1 Nov. 30, 2017

(30) Foreign Application Priority Data

May 27, 2016 (JP) ..... 2016-106292

(51) Int. Cl.
*B41J 2/165* (2006.01)
*B41J 2/16* (2006.01)
*B41J 2/14* (2006.01)

(52) U.S. Cl.
CPC ..... *B41J 2/16505* (2013.01); *B41J 2/14024* (2013.01); *B41J 2/14072* (2013.01); *B41J 2/162* (2013.01); *B41J 2/1632* (2013.01); *B41J 2/1652* (2013.01); *B41J 2/16508* (2013.01); *B41J 2/16532* (2013.01); *B41J 2/16585* (2013.01); *B41J 2002/14459* (2013.01); *B41J 2202/12* (2013.01); *B41J 2202/20* (2013.01)

(58) Field of Classification Search
CPC combination set(s) only.
See application file for complete search history.

(56) References Cited

U.S. PATENT DOCUMENTS 6,659,591 B2 12/2003 Sato et al.
7,789,499 B2 9/2010 Iwanaga et al.
8,177,330 B2 * 5/2012 Suganuma ..... B41J 2/1408 347/50
8,678,556 B2 * 3/2014 Iwanaga ..... B41J 2/14024 29/890.1
9,126,409 B2 9/2015 Tamenaga et al.
9,211,718 B2 12/2015 Luedeman et al.
9,221,257 B2 12/2015 Moriya et al.
9,248,647 B2 2/2016 Iwanaga et al.
(Continued)

OTHER PUBLICATIONS

U.S. Appl. No. 15/388,792 Shingo Okushima, Takatsuna Aoki, Seiichiro Karita, Noriyasu Nagai, Tamaki Sato, Tetsushi Ishikawa, Yasuaki Tominaga, Manabu Otsuka, Shuzo Iwanaga, Tatsurou Mori, Kazuhiro Yamada, Akira Yamamoto, Zentaro Tamenaga, Akio Saito, filed Dec. 22, 2016.
(Continued)

*Primary Examiner* — Matthew Luu
*Assistant Examiner* — Tracey M McMillion
(74) *Attorney, Agent, or Firm* — Venable LLP

(57) ABSTRACT

In order that the interior of a cap member, in a case where the cap member abuts to a cover member, is allowed to have improved airtightness so that the cap member can sufficiently function, a sealing member is used to seal between the cover member and first and second flow path members for retaining the cover member.

17 Claims, 23 Drawing Sheets

(56) References Cited

U.S. PATENT DOCUMENTS

| | | | | |
|---|---|---|---|---|
| 9,254,658 | B2 | 2/2016 | Yamada et al. | |
| 9,469,111 | B2 | 10/2016 | Yamada et al. | |
| 2008/0018701 | A1* | 1/2008 | Lee | B41J 2/2135 347/37 |
| 2010/0013889 | A1* | 1/2010 | Yamamoto | B41J 2/1603 347/44 |
| 2010/0309257 | A1* | 12/2010 | Goto | B41J 2/14072 347/50 |
| 2013/0083120 | A1* | 4/2013 | Choy | B41J 2/16505 347/29 |
| 2015/0029265 | A1* | 1/2015 | Iwanaga | B41J 2/14024 347/50 |
| 2015/0197089 | A1 | 7/2015 | Karita et al. | |
| 2015/0239238 | A1 | 8/2015 | Yamada et al. | |

OTHER PUBLICATIONS

U.S. Appl. No. 15/390,847 Shingo Okushima, Seiichiro Karita, Takatsuna Aoki, Noriyasu Nagai, filed Dec. 27, 2016.

U.S. Appl. No. 15/485,648 Shingo Okushima, Seiichiro Karita, Takatsuna Aoki, Noriyasu Nagai, filed Apr. 12, 2017.

U.S. Appl. No. 15/584,503 Toru Nakakubo, Shingo Okushima, Satoshi Kimura, Takuya Iwano, Akira Yamamoto, filed May 2, 2017.

* cited by examiner

LIQUID EJECTION HEAD, LIQUID EJECTION APPARATUS, AND LIQUID EJECTION HEAD MANUFACTURE METHOD

BACKGROUND OF THE INVENTION

Field of the Invention

The present invention relates to a liquid ejection head, a liquid ejection apparatus, and a liquid ejection head manufacture method by which liquid such as ink is ejected.

Description of the Related Art

The specification of U.S. Pat. No. 9,211,718 discloses an inkjet printing head to eject liquid ink as a liquid ejection head. In the printing head, a plurality of printing element substrates having elements for ejecting liquid through ejection openings are arranged. A cover member is provided so as to surround the plurality of printing element substrates. When a surface of this cover member is abutted to (capped with) a cap member and the interior of the cap member comes into an airtight status, ink can be suppressed from being evaporated from the ejection opening of the printing head. The suction of the cap interior can provide a recovery processing to suck and discharge ink from the ejection opening of the printing head.

However, a manufacture variation of cover members and a manufacture variation of member of the printing head for forming an attachment face on which the cover member is attached may cause a risk where a gap is caused between the cover member and the member to which the cover member is attached. In particular, in the case of the specification of U.S. Pat. No. 9,211,718 disclosing a long printing head including a plurality of printing element substrates, a long cover member is required and the member of the printing head for forming an attachment face on which the cover member is attached requires a plurality of members, which tends to cause a gap between the cover member and the attachment face. When the attachment face for the cover member has a wiring member, the wiring member causes a concavo-convex shape, which tends to cause a gap between the cover member and the attachment face.

SUMMARY OF THE INVENTION

The present invention provides a liquid ejection head, a liquid ejection apparatus, and a liquid ejection head manufacture method to improve the airtightness of the interior of a cap member abutted to a cover member so that the cap member can function sufficiently.

In the first aspect of the present invention, there is provided a liquid ejection head, comprising:

a plurality of element substrates configured to include an ejection opening face on which an ejection opening is formed and an element for ejecting ink through the ejection opening;

a plurality of first retention members configured to retain the element substrates;

a second retention member configured to retain the plurality of first retention members;

a cover member configured to be provide on an upper side of the first retention members so as to extend along a direction along which the plurality of first retention members are arranged, the cover member including a face on which a cap member covering the ejection opening face is abutted; and a sealing member configured to seal a space surrounded by the plurality of first retention members, the second retention member, and the cover member.

In the second aspect of the present invention, there is provided a liquid ejection apparatus for ejecting liquid through a liquid ejection head, wherein:

the liquid ejection head comprises:

an element substrate configured to include an element for ejecting liquid through an ejection opening;

a retention member configured to retain the element substrate;

a cover member configured to be provided on an upper side of the retention member, the cover member including a face on which a cap member covering the ejection opening face is abutted; and a sealing member configured to seal between the retention member and the cover member, wherein:

a plurality of the element substrates are provided, and the retention member includes a plurality of first flow path members each of which has a liquid flow path and which retains the plurality of element substrates and a second flow path member which includes a liquid flow path and retains the plurality of first flow path members.

In the third aspect of the present invention, there is provided a method of manufacturing a liquid ejection head, comprising:

a step of retaining, on a retention member, an element substrate including an element for ejecting liquid through an ejection opening;

a step of attaching, on an upper side of the retention member, a cover member including a face on which a cap member covering the ejection opening is abutted; and a step of sealing between the cover member and the retention member by a sealing member, wherein:

a plurality of the element substrates are provided, and the retention member includes a plurality of first flow path members each of which has a liquid flow path and which retains the plurality of element substrates and a second flow path member which includes a liquid flow path and retains the plurality of first flow path members.

According to the present invention, the gap between the cover member and the retention member can be sealed to thereby improve the airtightness of the interior of the cap member abutted to the cover member, thus allowing the cap member to function sufficiently.

Further features of the present invention will become apparent from the following description of exemplary embodiments with reference to the attached drawings.

DESCRIPTION OF THE EMBODIMENTS

The following section will describe examples of embodiments of the present invention with reference to the drawings. However, the following embodiments do not limit the scope of the present invention. In the following embodiments, as examples of liquid ejection system, a so-called thermal system is used in which bubbles are caused in liquid by an electrothermal energy conversion element (heater) to thereby eject liquid. However, various other liquid ejection systems can be used such as a piezo system using a piezo element. A liquid ejection apparatus according to the following embodiment is configured to circulate liquid such as ink between a liquid tank and a liquid ejection head. However, the liquid ejection apparatus is not limited to this configuration and may use other forms.

First, before describing an embodiment of the present invention, the following section will describe a basic configuration of a liquid ejection apparatus 1000 and a liquid ejection head 3.

(Entire Configuration of Liquid Ejection Apparatus)

Figure 1:
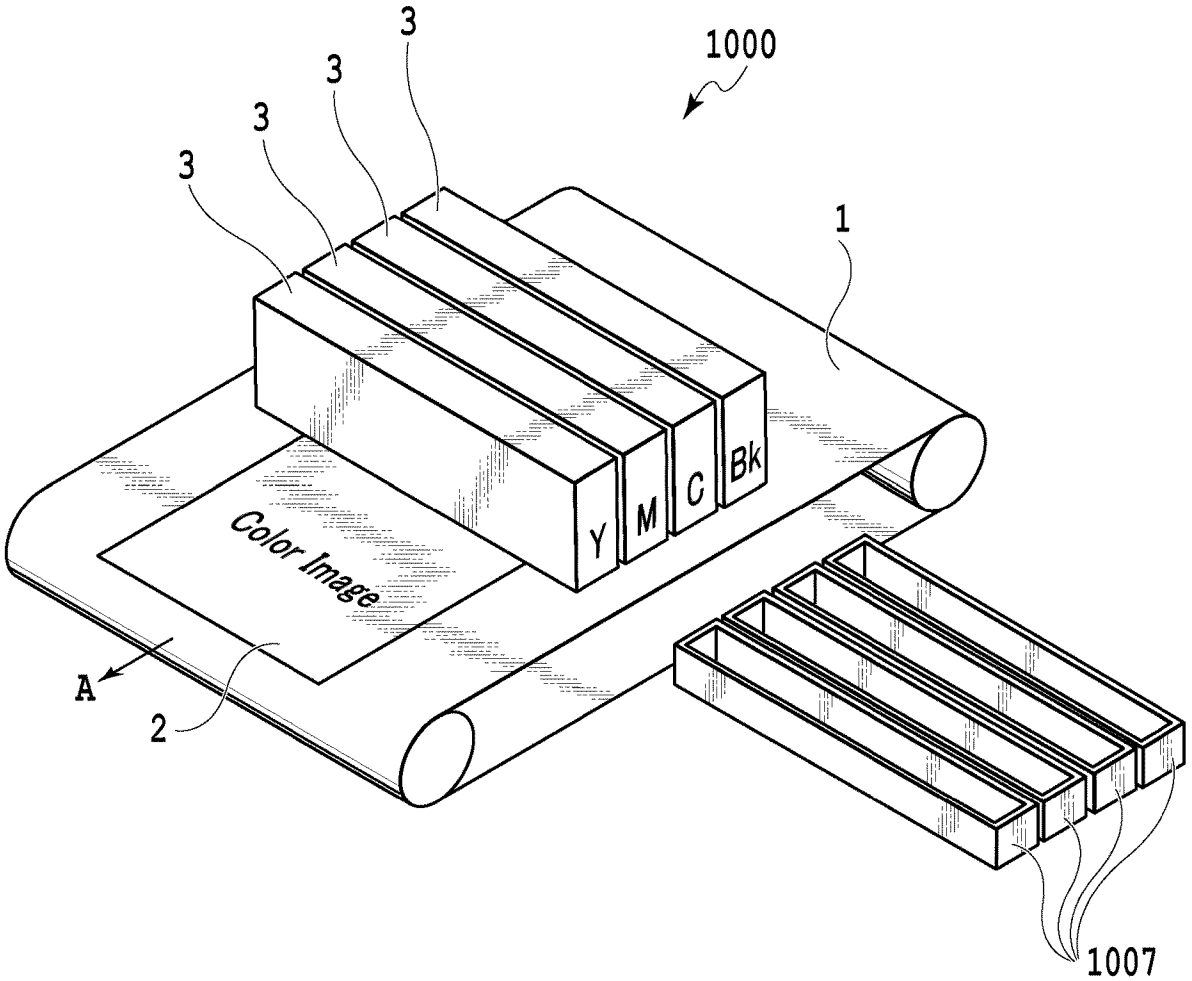
FIG. 1 is a perspective view to explain one example of the basic configuration of a liquid ejection apparatus of the present invention.

FIG. 1 is a schematic perspective view to explain the basic configuration of the liquid ejection apparatus 1000. The liquid ejection apparatus (inkjet printing apparatus) 1000 of this example includes therein four monochromatic liquid ejection heads (inkjet printing heads) arranged in a parallel manner that correspond to the respective ink colors of cyan (C), magenta (M), yellow (Y), and black (K). By allowing the corresponding inks (liquids) to be ejected through ejection openings of these liquid ejection heads 3, a color image is printed on a printing medium 2. In this example, as described later, one color ink corresponds to 20 ejection opening arrays. Thus, by appropriately allocating printing data to these ejection opening arrays, a very high-speed printing can provided. Furthermore, when an ejection opening has an ink ejection defect, ink can be ejected in an interpolated manner from an ejection opening of another ejection opening array at a position corresponding to the ejection opening having the ejection defect in a conveying direction of the printing medium 2 (the direction shown by an arrow A). This can consequently allow the printing operation to have improved reliability, which is particularly preferable in a commercial printing application for example. The liquid ejection head 3 is fluidically connected to an ink supply system, a buffer tank 1003, and a main tank 1006 in the liquid ejection apparatus 1000. The respective liquid ejection heads 3 are electrically connected to an electrical control unit to transmit electric power and an ejection control signal to the liquid ejection head 3.

(Liquid Circulation Path)

Figure 2:
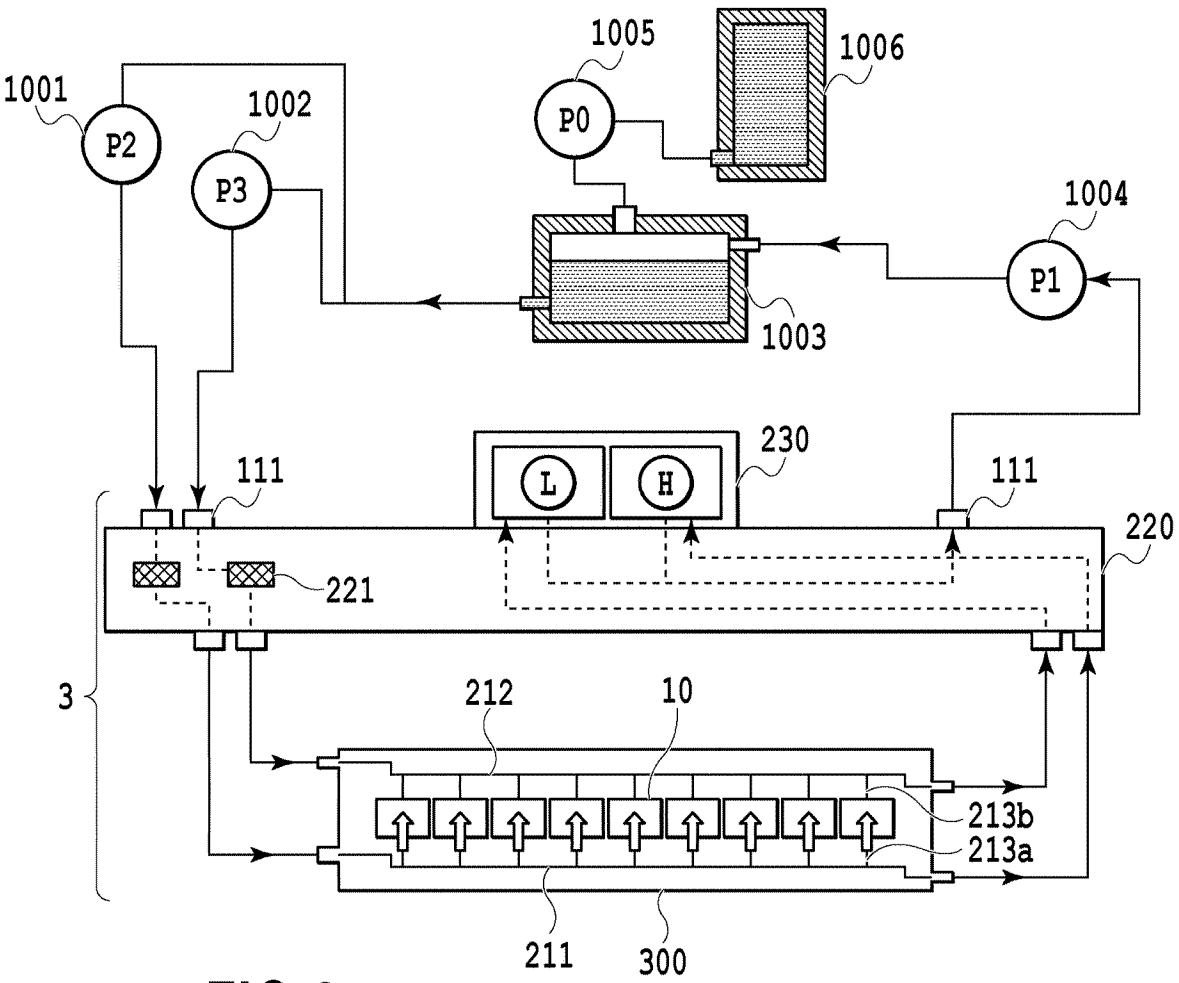
FIG. 2 illustrates a liquid supply system of the liquid ejection apparatus of FIG. 1.

The liquid ejection apparatus 1000 and the liquid ejection head 3 have therebetween a liquid circulation path (ink circulation path) such as a circulation path as shown in FIG. 2. Ink in the main tank 1006 is supplied by a refill pump 1005 to the buffer tank 1003. The ink in the buffer tank 1003 is supplied by the first circulation pump (high pressure side) 1001 and the first circulation pump (low pressure side) 1002 to a liquid ejection unit 300 via a liquid connecting component 111 and a liquid supply unit 220 of the liquid ejection head 3. The ink supplied to the liquid ejection unit 300 is circulated within the liquid ejection unit 300 as described later. The ink having been circulated in the liquid ejection unit 300 is sent through two negative pressure adjustment mechanisms (high pressure side (H), low pressure side (L)) of the liquid supply unit 220 and the negative pressure control unit 230, and is subsequently caused by a second circulation pump 1004 to return to the buffer tank 1003.

The respective two negative pressure adjustment mechanisms of the high pressure side (H) and the low pressure side (L) constituting the negative pressure control unit 230 control the pressure at an upstream side of the negative pressure control unit 230 within a fixed range having a center at a desired set pressure (or having the same function as that of a so-called "back pressure regulator"). The second circulation pump 1004 functions as a negative pressure source to depressurize a downstream side of the negative pressure control unit 230. The negative pressure control unit 230 functions to suppress, when a change in the printing duty (which corresponds to "the ink application amount per a unit printing region") causes a change in the ink flow rate during the printing operation of the liquid ejection head 3, the upstream side (the liquid ejection unit 300 side) from having a pressure fluctuation. Specifically, the negative pressure control unit 230 stabilizes the pressure so that the pressure is within a fixed range having a center at a preset pressure. As shown in FIG. 2, the second circulation pump 1004 is preferably used to pressurize the downstream side of the negative pressure control unit 230 via the liquid supply unit 220. This can consequently suppress the influence by the hydraulic head pressure of the buffer tank 1003 on the liquid ejection head 3 to thereby increase the options of the layout of the buffer tank 1003 in the liquid ejection apparatus 1000. The second circulation pump 1004 also can be substituted with a water head tank provided to have a predetermined water head difference to the negative pressure control unit 230 for example.

The negative pressure control unit 230 of FIG. 2 has two negative pressure adjustment mechanisms of the high pressure set side (H) and the low pressure side (L) set to have mutually-different control pressures. The respective negative pressure adjustment mechanisms are connected via the interior of the liquid supply unit 220 to a common supply flow path 211 and a common collection flow path 212 in the liquid ejection unit 300. The two negative pressure adjustment mechanisms allow the common supply flow path 211 to have a pressure relatively higher than the pressure of the common collection flow path 212. As a result, ink is allowed to flow from the common supply flow path 211 to the common collection flow path 212 through an individual supply flow path 213*a* and an individual collection flow path 213*b*. This consequently allows the ink flow as shown by the arrow in FIG. 2 to occur in the internal flow path of the printing element substrate 10 as described later.

(Configuration of Liquid Ejection Head)

Figure 3A:
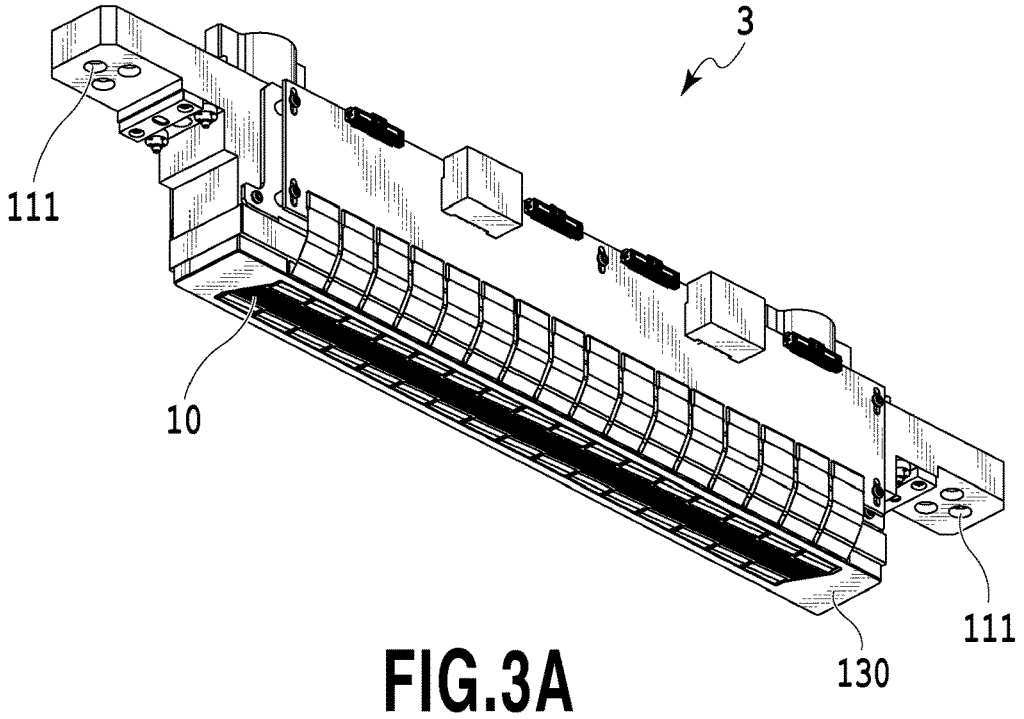
FIG. 3A and FIG. 3B are perspective views to explain one example of the basic configuration of the liquid ejection head of the present invention, respectively.
Figure 3B:
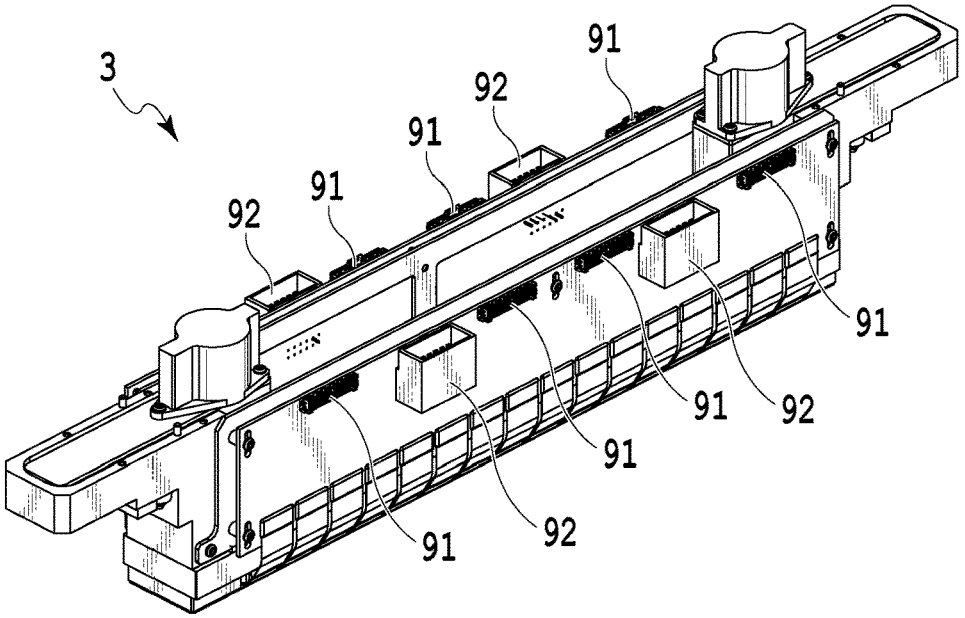

FIG. 3A and FIG. 3B are perspective views to explain the configuration example of the liquid ejection head 3. The liquid ejection head 3 of this example is an inkjet line-type printing head by which ink (liquid) of one color can be ejected. The liquid ejection head 3 has, in the longitudinal direction thereof, 16 printing element substrates 10 arranged on a straight line. The liquid ejection head 3 includes liquid connecting components 111, signal input terminals 91, and electric power supply terminals 92. The signal input terminals 91 and the electric power supply terminals 92 are provided at both sides of the liquid ejection head 3. The reason is to reduce a voltage reduction and a signal transmission delay caused in the wiring component of the printing element substrate 10.

Figure 4:
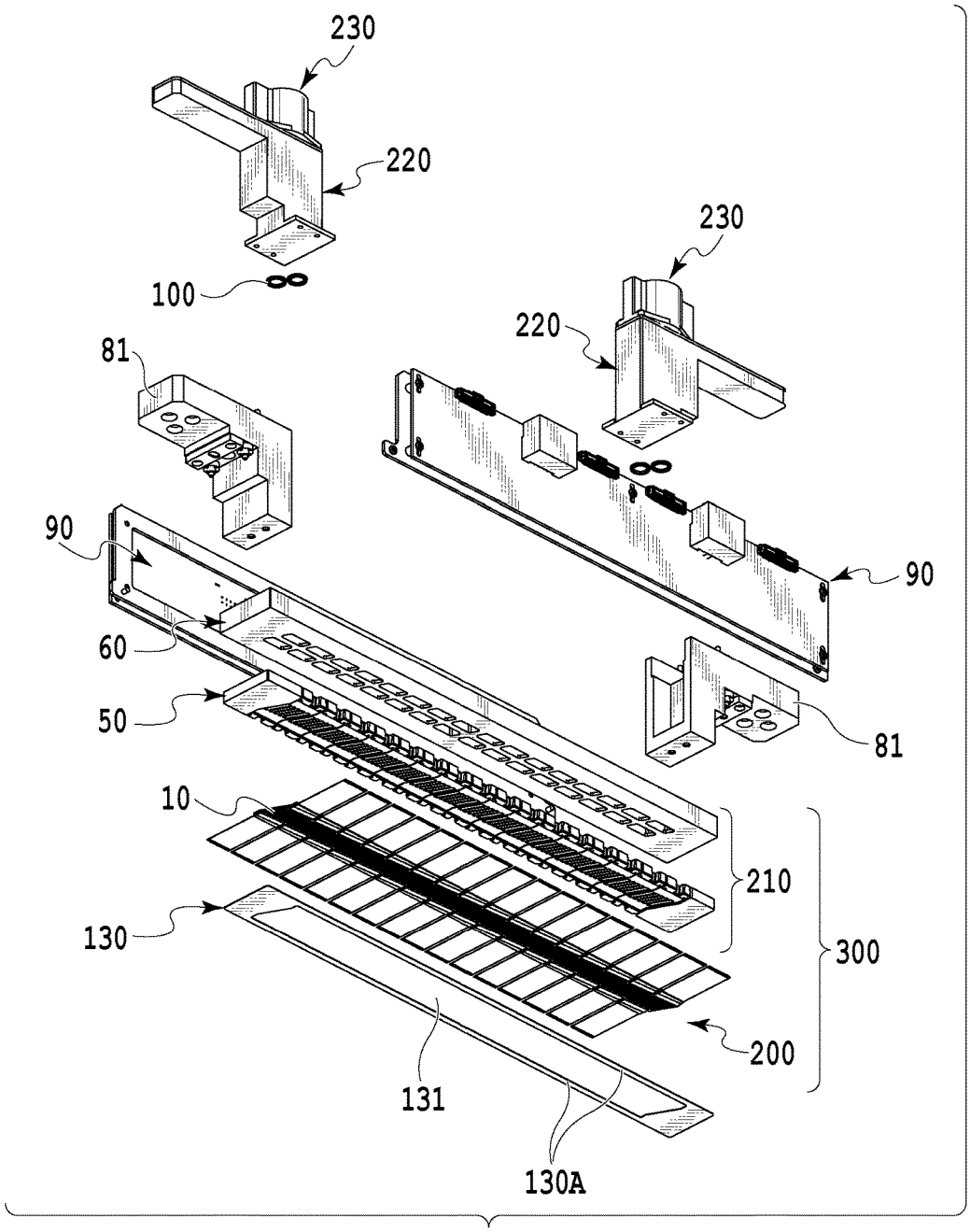
FIG. 4 is an exploded perspective view illustrating the liquid ejection head of FIG. 3.

FIG. 4 is an exploded perspective view of the liquid ejection head 3 in which parts and units constituting the liquid ejection head 3 are shown in a classified manner based on the functions thereof. The liquid ejection head 3 of this example has such rigidity that is supported by a second flow path member 60 included in the liquid ejection unit 300. A support component 81 of the liquid ejection unit 300 is connected to both ends of the second flow path member 60. The liquid ejection unit 300 positions the liquid ejection head 3 by being mechanically connected to a carriage of the liquid ejection apparatus 1000. The liquid supply unit 220 including the negative pressure control unit 230 and an electrical wiring substrate 90 are connected to the support component 81. The two liquid supply units 220 include therein filters (not shown), respectively. The two negative pressure control units 230 control the pressure based on different negative pressures (high pressure, low pressure), respectively. When both ends of the liquid ejection head 3 have, as shown in FIG. 4, the negative pressure control unit 230 of the high pressure side and the low pressure side, respectively, then the liquids in the common supply flow path 211 and the common collection flow path 212 extending in the longitudinal direction of the liquid ejection head 3 are caused to flow in opposing directions. This consequently promotes the heat exchange by the liquids passing through the common supply flow path 211 and the common collection flow path 212, thereby reducing the temperature difference in these flow paths 211 and 212. This can consequently suppress the temperature difference in the plurality of printing element substrates 10 along these flow paths 211 and 212 to thereby suppress a printed image having an uneven density caused by the temperature difference.

As shown in FIG. 4, the liquid ejection unit 300 has a flow path member 210 obtained by layering the first flow path member 50 and the second flow path member 60. The flow path member 210 distributes the liquid supplied from the liquid supply unit 220 to the plurality of ejection modules 200, respectively. The first flow path member 50 is adhered to the second flow path member 60 via adhesive agent. The flow path member 210 functions as a flow path member to return the liquid circulated from the ejection module 200 to the liquid supply unit 220. The second flow path member 60 in the flow path member 210 includes therein the common supply flow path 211 and the common collection flow path 212 to provide the rigidity to the liquid ejection head 3. Thus, the second flow path member 60 is preferably made of such material that has a sufficient corrosion resistance to liquid and a high mechanical strength. Specific examples preferably include SUS, Ti, and alumina for example. The flow path member 210 also functions as a retention member to retain a cover member (which will be described later) provided at the upper side thereof. The retention member of this example includes the first flow path member 50 and the second flow path member 60.

Figure 5:
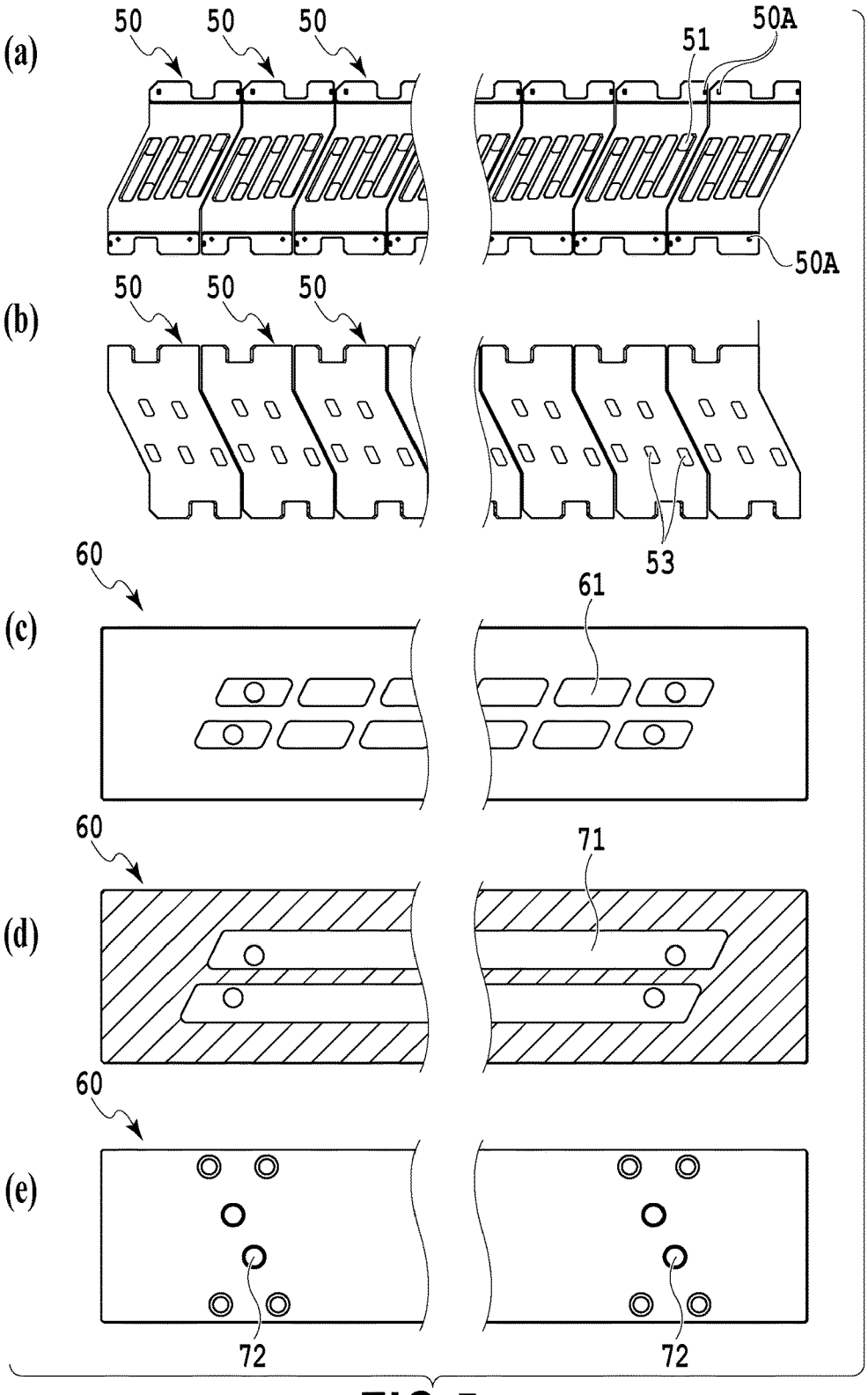
FIG. 5 is a plan view illustrating a flow path member in FIG. 4.

A part (a) of FIG. 5 is a plan view illustrating a face of the first flow path member 50 on which the ejection module 200 is mounted. A part (b) of FIG. 5 is a plan view illustrating a face of the first flow path member 50 (a back face of the face illustrated in the part (a) of FIG. 5) on which the second flow path member 60 is abutted. The first flow path members 50 are a plurality of members arranged to be abutted to the ejection modules 200 so as to correspond to the respective ejection modules 200. The use of such a separate structure of the first flow path members 50 allows the plurality of the ejection modules 200 to be arranged so as to correspond to the length of the liquid ejection head. This separate structure can be particularly preferably applied to a relatively long-scale liquid ejection head used for printing media having a B2 size or more. The first flow path member 50 is configured so that a communication opening 51 of the part (a) of FIG. 5 is in fluid communication with the ejection module 200. An individual communication opening 53 of the part (b) of FIG. 5 is in fluid communication with a communication opening 61 of the second flow path member 60 (which will be described later). The first flow path member 50 includes a convex component 50A.

A part (c) of FIG. 5 is a plan view illustrating a face of the second flow path member 60 on which the first flow path member 50 is abutted. A part (d) of FIG. 5 is a cross-sectional view illustrating a center of the second flow path member 60 in the thickness direction. A part (e) of FIG. 5 is a plan view illustrating a face of the second flow path member 60 (a back face of the face illustrated in the part (c)

of FIG. 5) on which the liquid supply unit 220 is abutted. The second flow path member 60 has two common flow path grooves 71 one of which forms the common supply flow path 211 in FIG. 6 and the other of which forms the common collection flow path 212 in FIG. 6. These flow paths 211 and 212 are configured so that liquid is supplied from one end to the other end in the longitudinal direction of the liquid ejection head 3. In the case of this example, liquids in these flow paths 211 and 212 flow in opposite directions.

Figure 6:
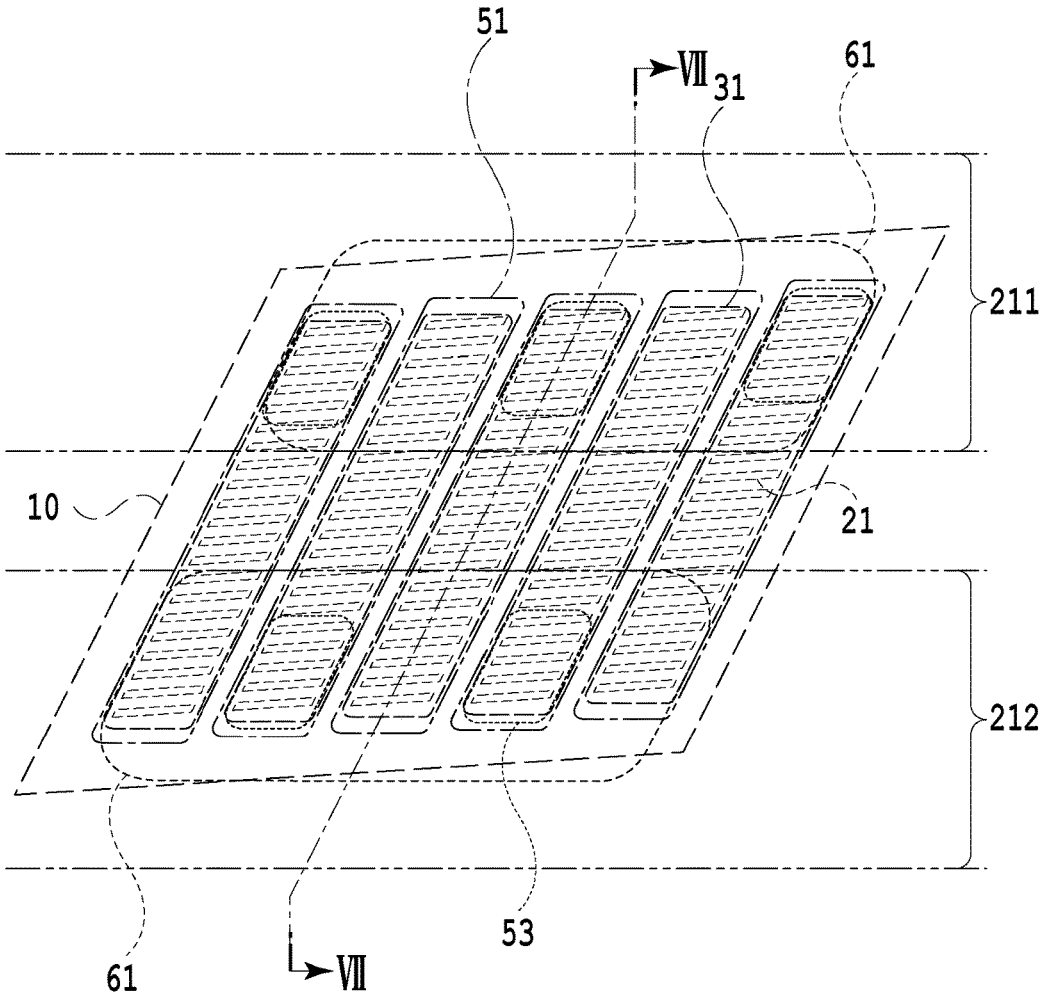
FIG. 6 is a transparent view to explain the relation between an element substrate and the flow path member in FIG. 4.

FIG. 6 is a transparent view to explain a liquid connection relation between the printing element substrate 10 and the flow path member 210. FIG. 6 shows positions of liquid communication openings 31 provided in the ejection module 200 and positions of flow paths and communication openings provided in the flow path member 210. As shown in FIG. 6, the flow path member 210 includes therein one pair of the common supply flow path 211 and the common collection flow path 212 extending in the longitudinal direction of the liquid ejection head 3. The communication opening 61 of the second flow path member 60 and the individual communication opening 53 of the first flow path member 50 are mutually connected while being aligned. A liquid supply path is formed from a communication opening 72 of the second flow path member 60 via the common supply flow path 211 to the communication opening 51 of the first flow path member 50. Similarly, a liquid supply path is also formed that extends from the communication opening 72 of the second flow path member 60 via the common collection flow path 212 to communicate with the communication opening 51 of the first flow path member 50.

Figure 7:
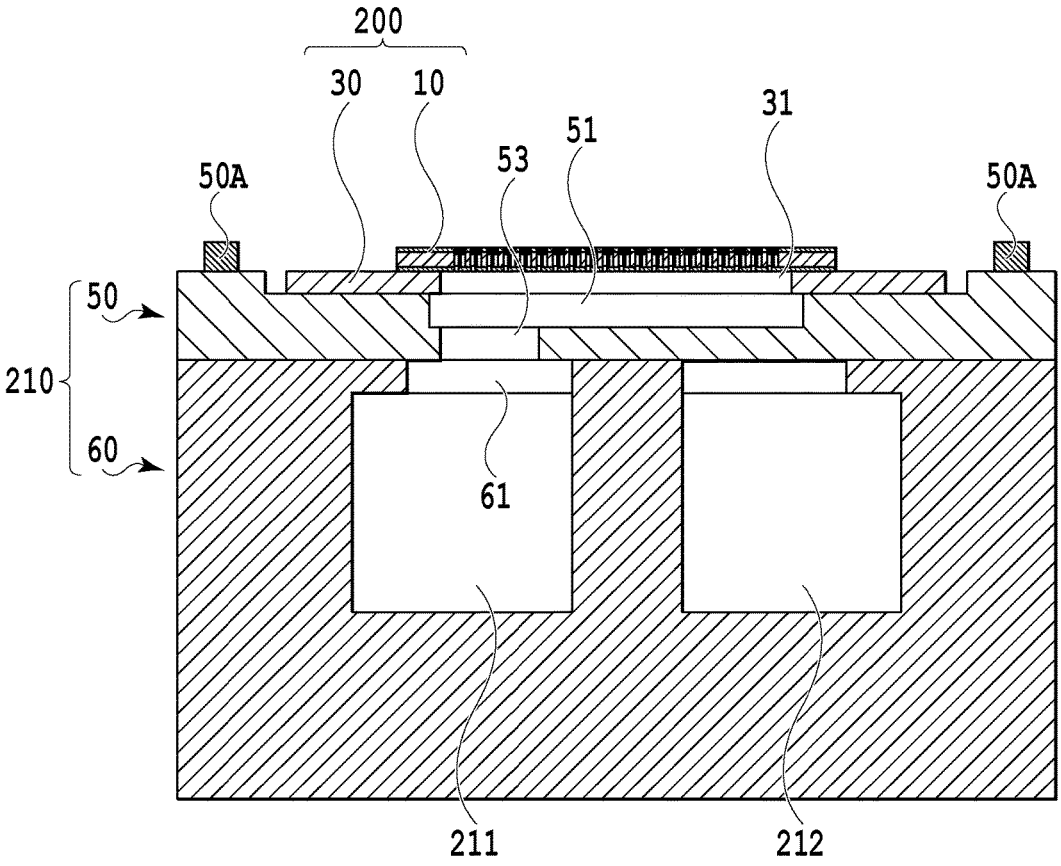
FIG. 7 is a cross-sectional view taken along the line VII-VII of FIG. 6.

FIG. 7 is a cross-sectional view taken along a line VII-VII of FIG. 6. The common supply flow path 211 is connected to the ejection module 200 via the communication opening 61, the individual communication opening 53, and the communication opening 51. It is clear from FIG. 6 that the common collection flow path 212 is connected to the ejection module 200 via a similar path in another cross section of FIG. 7. The ejection module 200 of the printing element substrate 10 includes therein a flow path communicating with an ejection opening 13. The supplied liquid is circulated by being partially or entirely sent through the ejection opening 13 (or a pressure room 23) for which the ejection operation is stopped. Specifically, in this example, the ink supplied to the pressure room 23 can be circulated between the pressure room 23 and the exterior. In this example, the common supply flow path 211 is connected, as shown in FIG. 2, via the liquid supply unit 220 to the high pressure side of the negative pressure control unit 230 and the common collection flow path 212 is connected via the liquid supply unit 220 to the low pressure side of the negative pressure control unit 230. Thus, a liquid differential pressure causes ink to flow from the common supply flow path 211 to pass through the pressure room communicating with the ejection opening 13 of the printing element substrate 10 to reach the common collection flow path 212.

As shown in FIG. 7, the flow path member 210 also functions as a retention member to retain the printing element substrate 10 via a support member 30 for supporting the printing element substrate 10. Thus, the term "retain" herein includes a case where the printing element substrate 10 is indirectly supported via another member. The respective plurality of the first flow path members 50 included in the flow path member 210 also function as the first retention member to retain the ejection module 200. The second retention member 60 also functions as the second retention member to retain the plurality of first flow path members 50.

(Configuration of Ejection Module)

Figure 8A:
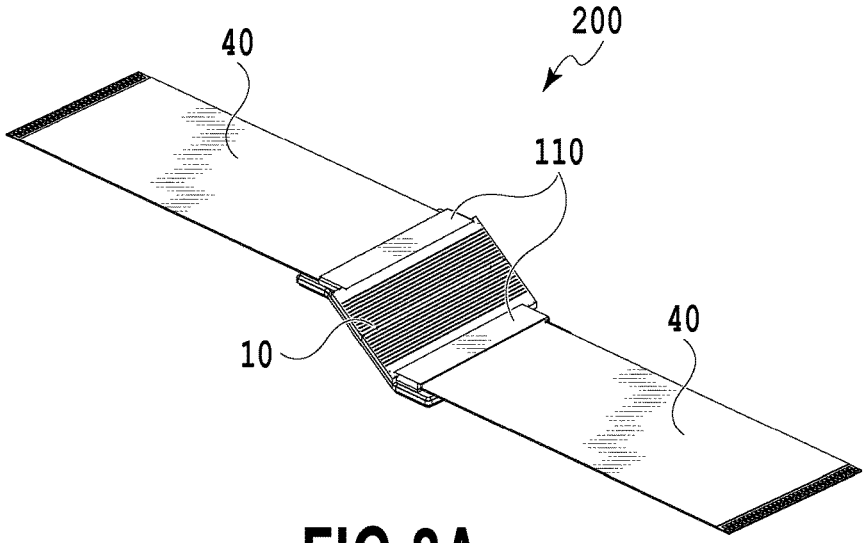
FIG. 8A and FIG. 8B are perspective views of the element substrate in FIG. 4, respectively.
Figure 8B:
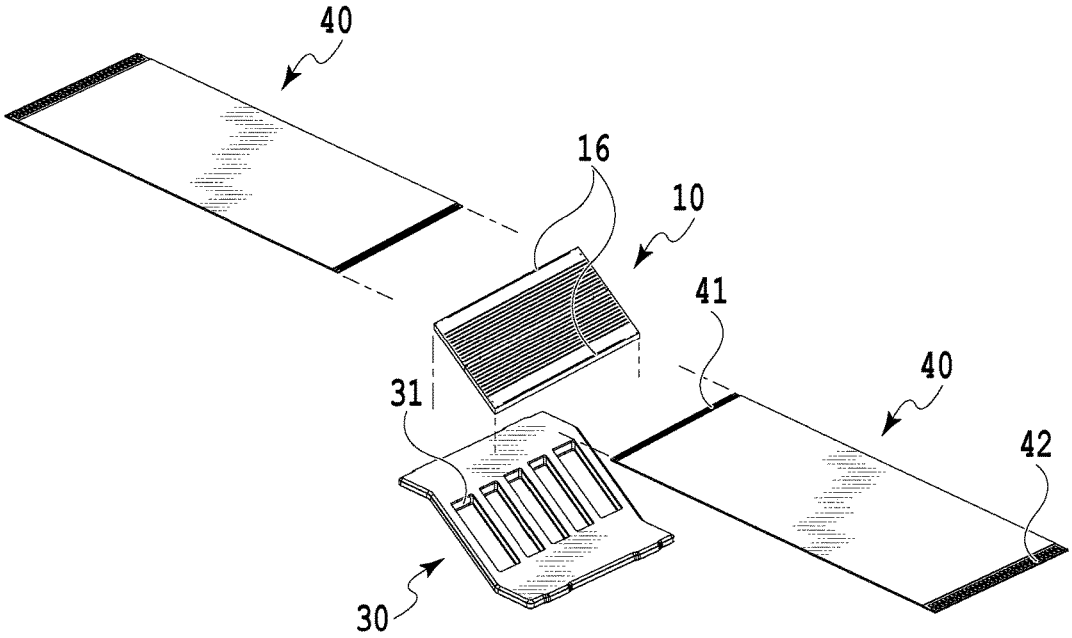

FIG. 8A is a perspective view illustrating one ejection module 200. FIG. 8B is an exploded perspective view illustrating the ejection module 200.

The ejection module 200 has the printing element substrate 10, the two flexible wiring substrates 40, and the support member 30 for supporting the printing element substrate 10. The printing element substrate 10 includes a plurality of ejection opening arrays. Both sides (long sides) of the printing element substrate 10 along the ejection opening array have a plurality of terminals 16. The two flexible wiring substrates 40 electrically connected to these terminals 16 are connected to printing element substrate 10 so as to correspond to both sides of the printing element substrate 10. The reason is that, in the case of this example, providing 20 ejection opening arrays formed in the printing element substrate 10 requires a proportional increase of wirings. This can consequently reduce the maximum distance from the terminal 16 to the printing element 15 corresponding to the ejection opening array to thereby reduce the voltage reduction and signal transmission delay caused in a wiring component in the printing element substrate 10. The support member 30 that supports the printing element substrate 10 while being abutted thereto has the liquid communication opening 31 that is opened to extend over all ejection opening arrays in the printing element substrate 10.

(Configuration of Printing Element Substrate)

Figure 9A:
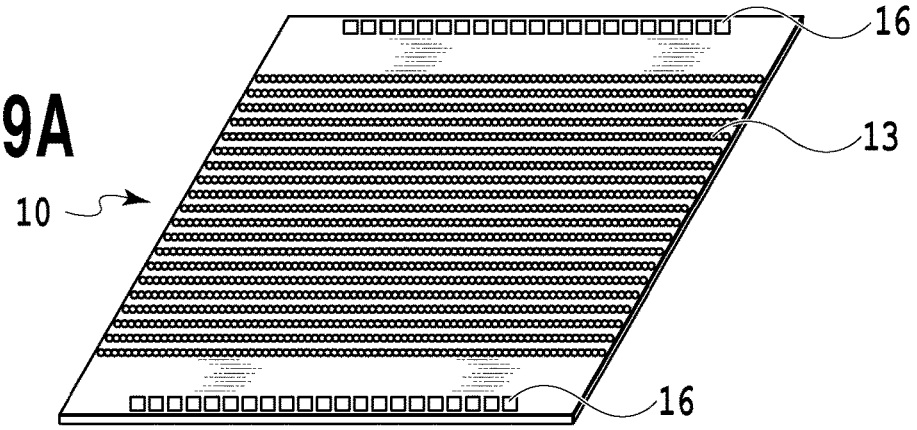
FIG. 9A, FIG. 9B, and FIG. 9C are schematic views illustrating the printing element substrate of FIG. 8, respectively.
Figure 9B:
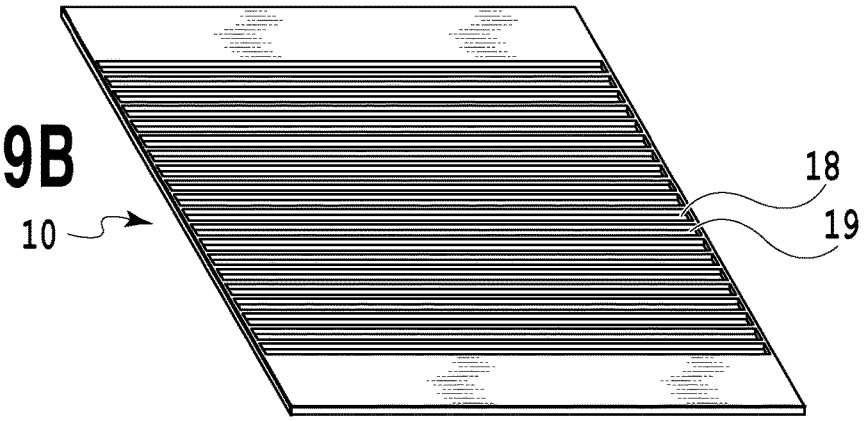
Figure 9C:
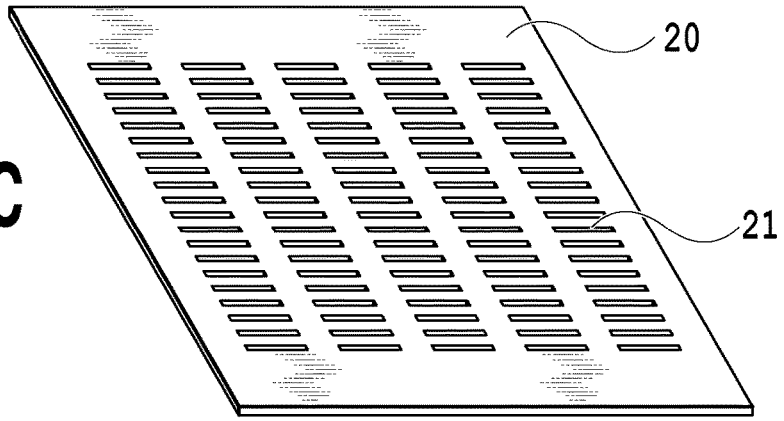

FIG. 9A is a schematic view illustrating a face of the printing element substrate 10 on which the ejection opening 13 is provided. FIG. 9B is a schematic view illustrating a back face of the printing element substrate 10 at the opposite side of the face of FIG. 9A. The printing element substrate 10 has an ejection opening formation member 12 including an array of the plurality of ejection openings 13 (ejection opening array). The direction along which the ejection opening array including the plurality of ejection openings 13 extends will be hereinafter referred to as "ejection opening array direction".

Figure 10:
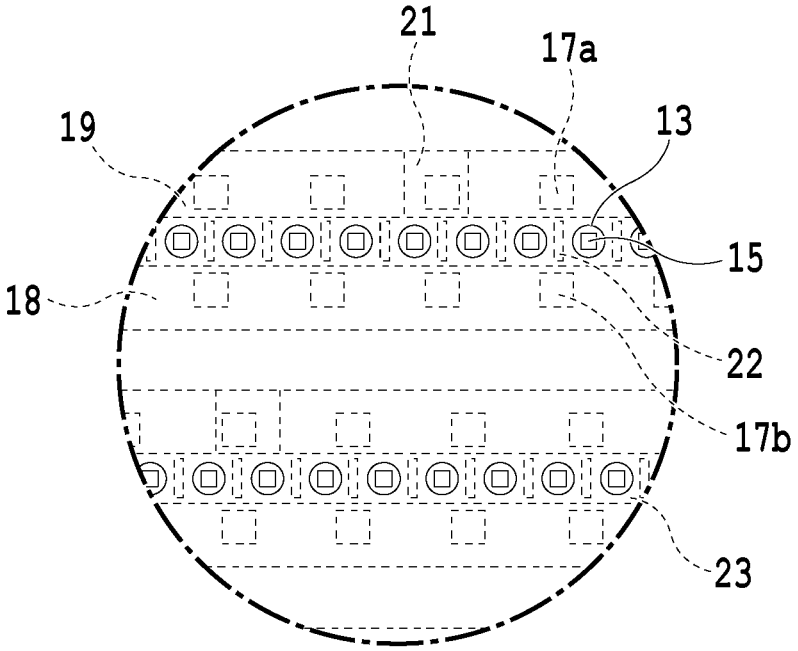
FIG. 10 is a schematic view illustrating a face of the printing element substrate of FIG. 9A.

FIG. 10 is a schematic view illustrating the face of the printing element substrate 10 in the case where a cover member 20 provided on the back face of the printing element substrate 10 is removed. The printing element substrate 10 is configured so that a position corresponding to the ejection opening 13 has a heat generation element (printing element) 15 functioning as an ejection energy generating unit to eject liquid by foaming liquid by thermal energy. A partition wall 22 partitions the pressure room 23 including therein the printing element 15. The printing element 15 is electrically connected to the terminal 16 of FIG. 9A via an electrical wiring (not shown) provided in the printing element substrate 10. The printing element 15 generates heat based on a pulse signal inputted from the control circuit of the liquid ejection apparatus 1000 via the electrical wiring substrate 90 (see FIG. 4) and the flexible wiring substrate 40 (see FIG. 8A) to thereby boil liquid. The liquid foaming energy by this boiling is used to eject liquid through the ejection opening 13. The back face of the printing element substrate 10 has a liquid supply path 18 and a liquid collection path 19 alternately provided along the ejection opening array direction. The liquid supply path 18 and the liquid collection path 19 are flow paths provided in the printing element substrate 10 so as to extend in the ejection opening array direction and communicate with the ejection opening 13 via a supply opening 17*a* and a collection opening 17*b*, respectively. The cover member 20 provided at the back face side of the printing element substrate 10 has an opening 21 (see FIG.

9C) communicating with the liquid communication opening 31 of the support member 30.

(Positional Relation Between Printing Element Substrates)

Figure 11A:
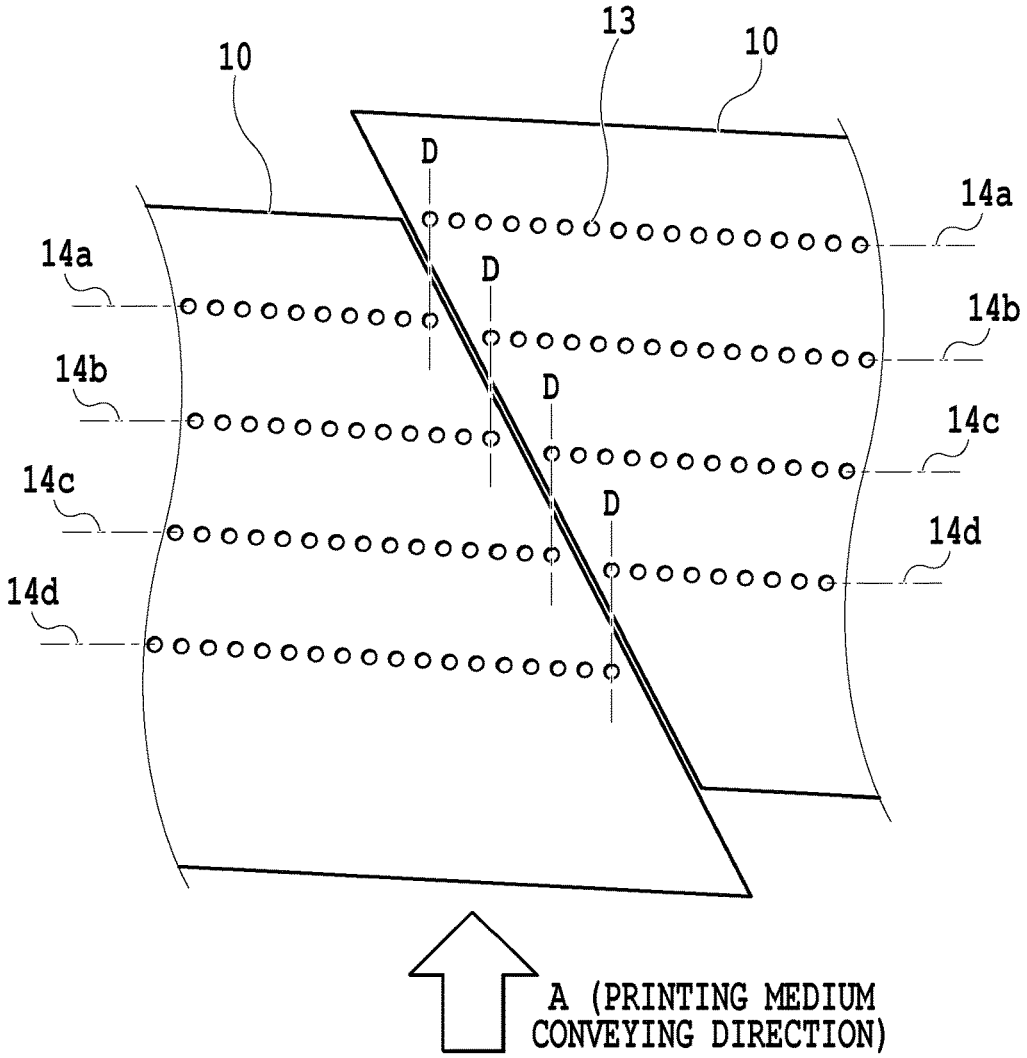
FIG. 11A is a diagram to explain a neighboring portion of two printing element substrates.

FIG. 11A is a partially-enlarged plan view illustrating a neighboring portion of two printing element substrates 10 adjacent to each other. In this example, the printing element substrate 10 having a substantially parallelogram-like shape is used as shown in FIG. 9A. As shown in FIG. 11A, each printing element substrate 10 is provided so that the ejection opening arrays (14*a* to 14*d*) including therein the ejection openings 13 are inclined at a fixed angle to the printing medium conveying direction (the direction shown by the arrow A). The ejection opening arrays at the neighboring portion at which the printing element substrates 10 are adjacent to each other are provided so that at least two ejection openings 13 are overlapped in the conveying direction. In the example of FIG. 11A, the two ejection openings 13 on a line D are mutually overlapped. In such an arrangement, even when the printing element substrate 10 is displaced from a predetermined position, the overlapped ejection openings 13 can be driven-controlled to thereby cause a black stripe or void on a printed image to be less conspicuous. When an image is printed by allocating image data to a plurality of ejection opening arrays as in this example, there is no need for the overlapped ejection openings 13. In this case, an image can be allocated to different ejection opening arrays between the printing element substrates 10 adjacent to each other to thereby cause a black stripe or void on a printed image to be less conspicuous.

The plurality of printing element substrates 10 also may be arranged on a straight line (inline) instead of the staggered arrangement. In this case, the use of the arrangement as shown in FIG. 11A can also suppress, while suppressing the increase of the length of the liquid ejection head 3 in the printing medium conveying direction, a black stripe or void from being generated at a portion at which the printing element substrates 10 are connected. The shape of the printing element substrate 10 is not limited to a parallelogram plane as in this example and may be an arbitrary shape, including a plane having an oblong shape, a trapezoidal shape, or other shape for example.

(Configuration of Cover Member)

Figure 11B:
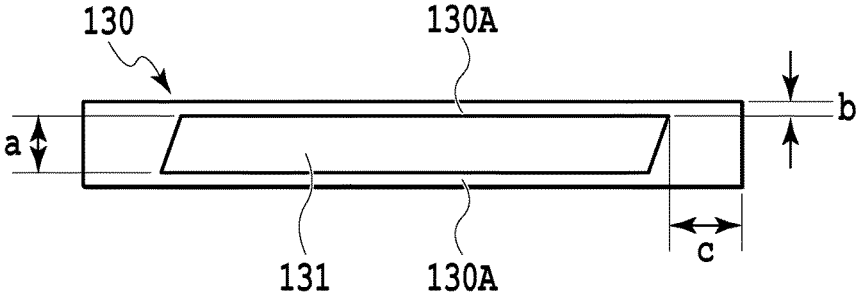
FIG. 11B is a diagram to explain a cover member.

FIG. 11B is a plan view to explain one example of a cover member (face cover) 130. The cover member 130 includes an opening portion 131. The opening portion 131 is provided at a position corresponding to the printing element substrate 10 arranged as shown in FIG. 4. In order to reduce the length of the liquid ejection head 3 in the printing medium conveying direction, no joint for example is provided at the position of the opening portion 131 corresponding to a boundary between the printing element substrates 10. Specifically, both ends 130A of the cover member 130 extend in a direction along which the plurality of printing element substrates 10 are arranged. No joint for example is provided between both ends 130A at a portion corresponding to a boundary between the printing element substrates 10. Thus, the opening portion 131 is opened over the entire length of the liquid ejection head 3, i.e., over the entire length of the printing width of the printing medium. The cover member 130 is configured in a frame-like manner by the opening portion 131 as described above. The cover member 130 attached to the liquid ejection head 3 functions to flatten a face of the liquid ejection head 3 opposed to the printing medium (except for the printing element substrate 10). This can consequently reduce the uneven air current caused by conveying the printing medium and ejecting the liquid through the liquid ejection head 3 to thereby improve the landing accuracy of the liquid ejected through the liquid ejection head 3. This can also allow, when the ejection opening face of the liquid ejection head 3 is capped by a cap member 1007 (see FIG. 1) during a no-printing operation, the liquid ejection head 3 to be abutted to the cap member 1007, thereby providing improved airtightness.

(Capping Operation)

In the liquid ejection apparatus 1000 of FIG. 1, during the no-printing operation, the liquid ejection head 3 is capped by the cap member 1007 so that the cap member 1007 is abutted to the cover member 130 to thereby suppress ink from being evaporated from the ejection opening 13. In such a capping status, the interior of the cap member 1007 is allowed to have a negative pressure by a pump to suck and remove bubbles and ink having an increased viscosity from the interior of the ejection opening 13 to the cap member 1007. The existence of the seamless and flat cover member 130 provided over the entire periphery of the liquid ejection head 3 can improve the airtightness in the capping status.

(First embodiment)

Figure 12A:
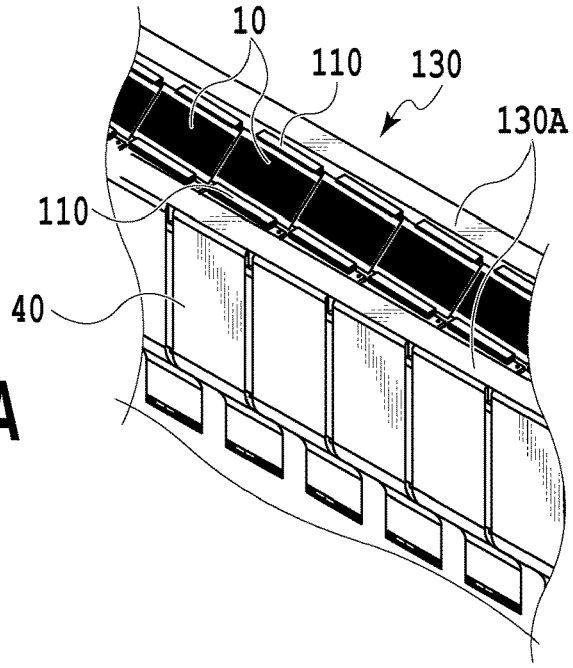
FIG. 12A, FIG. 12B, and FIG. 12C are diagrams to explain a liquid ejection head as a comparison example of the present invention, respectively.
Figure 12B:
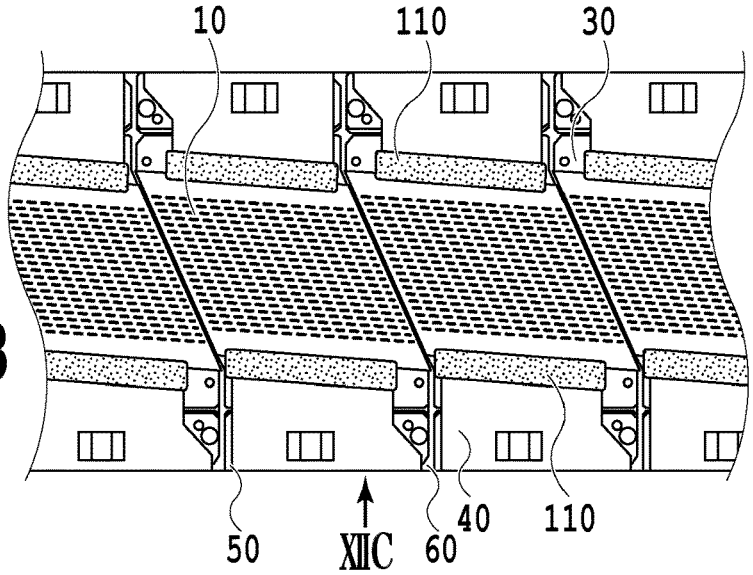
Figure 12C:
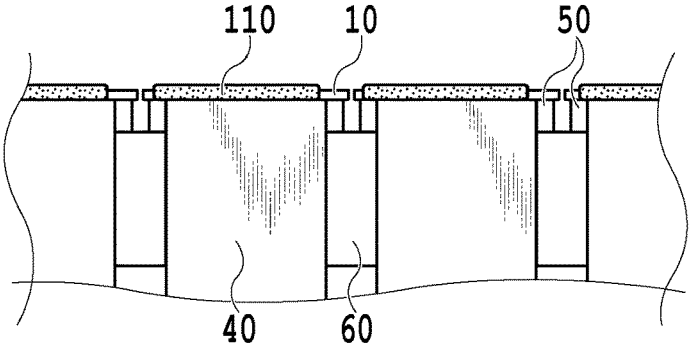
Figure 13A:
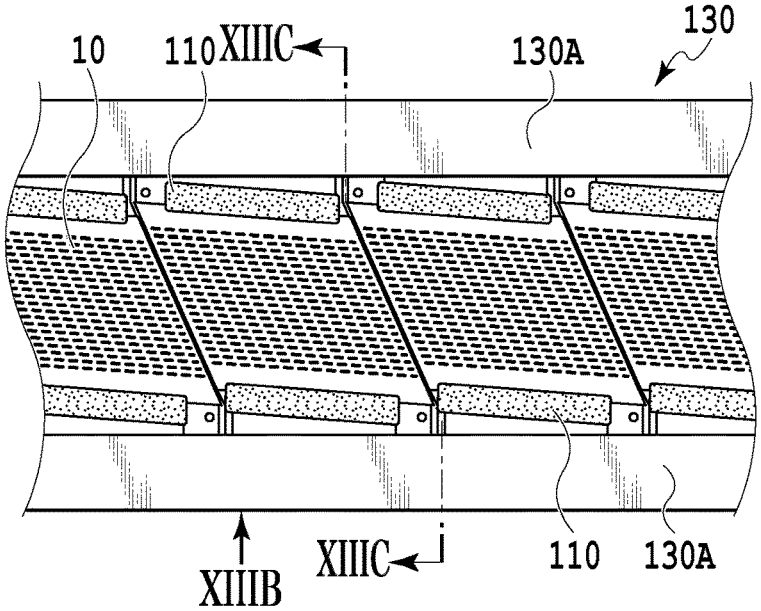
FIG. 13A, FIG. 13B, and FIG. 13C are diagrams to explain a liquid ejection head as a comparison example of the present invention, respectively.
Figure 13B:
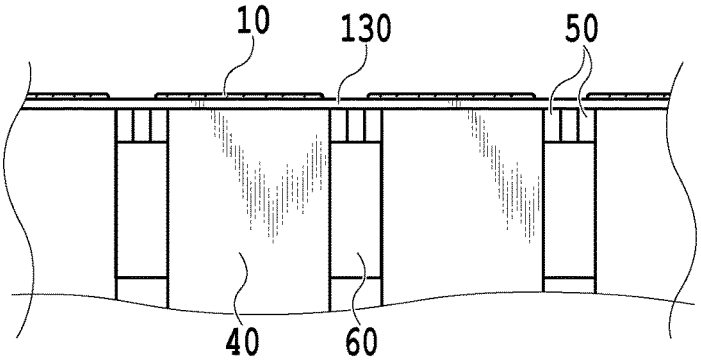
Figure 13C:
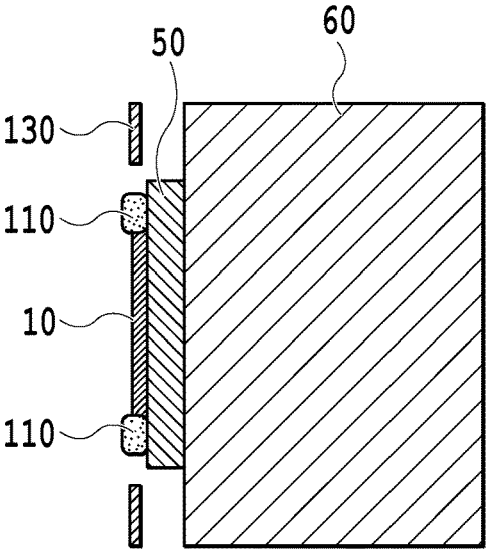
Figure 14A:
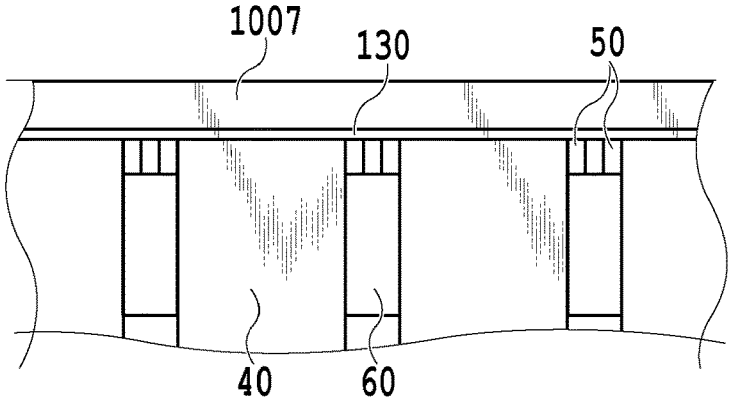
FIG. 14A, FIG. 14B, and FIG. 14C are diagrams to explain a liquid ejection head as a comparison example of the present invention, respectively.
Figure 14B:
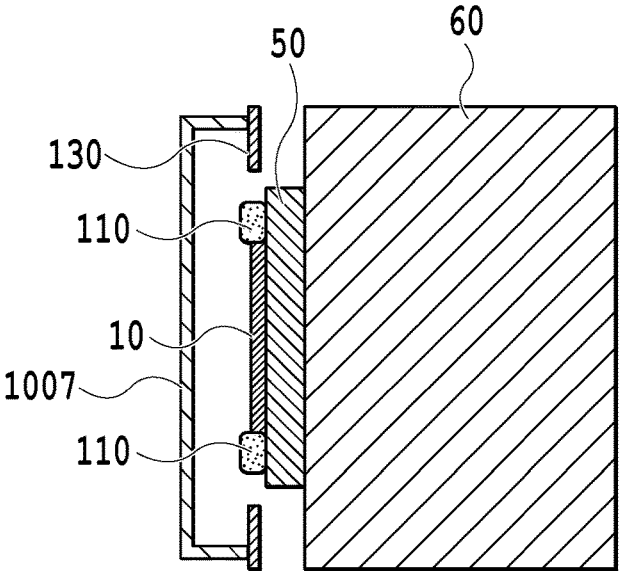
Figure 14C:
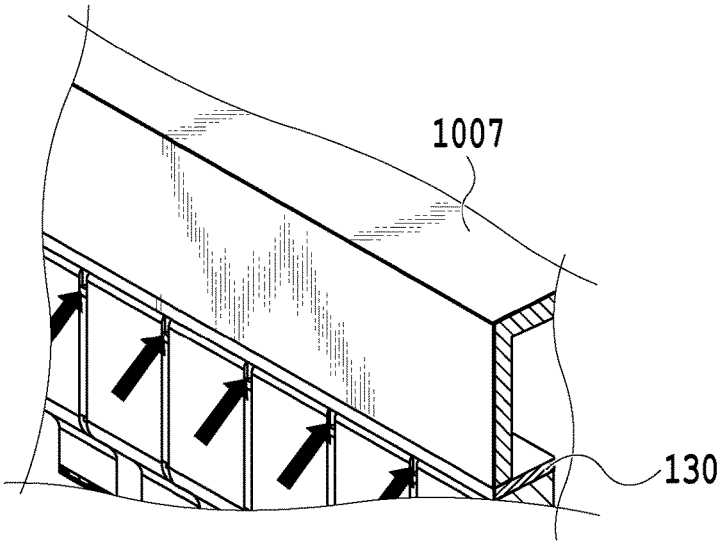

FIG. 12A to FIG. 14C are diagrams to explain a comparison example of the liquid ejection head. FIG. 12A is a perspective view illustrating the liquid ejection head. FIG. 12B is a top view of the liquid ejection head prior to being attached with the cover member 130. FIG. 12C is an arrow view along a direction XIIC of FIG. 12B. FIG. 13A is a top view illustrating the liquid ejection head being attached with the cover member 130. FIG. 13B is a cross-sectional view along a direction XIIIB of FIG. 13A. FIG. 13C is an arrow view along a line XIIIC-XIIIC of FIG. 13A. FIG. 14A is a side view illustrating the liquid ejection head abutted to the cap member 1007. FIG. 14B is a diagram similar to FIG. 13C when the liquid ejection head is abutted to the cap member 1007. FIG. 14C illustrates the leakage status of the negative pressure in the cap member 1007 when the cap member 1007 is abutted to the cover member 130 and the interior of the cap member 1007 is sucked by a not-shown suction mechanism.

As shown in FIG. 13C, a portion corresponding to the boundary between the printing element substrates 10 has a gap between the cover member 130 and the first flow path member 50 and a gap between the cover member 130 and the second flow path member 60. FIG. 14B shows a status in which the cap member 1007 is abutted to the cover member 130 so as to form a sealed space in the cap member 1007. In this status, the gaps between the cover member 130 and the first and second flow path members 50 and 60 allow the interior of the cap member 1007 to communicate with atmospheric air. Thus, when the interior of the cap member 1007 is sucked, these gaps cause, as shown in arrows in FIG. 14C, the leakage of the negative pressure in the cap member 1007. This causes a risk where the space in the cap member 1007 cannot receive a desired suction pressure and an ink suction recovery operation cannot be securely performed, causing an ink ejection defect.

Figure 15A:
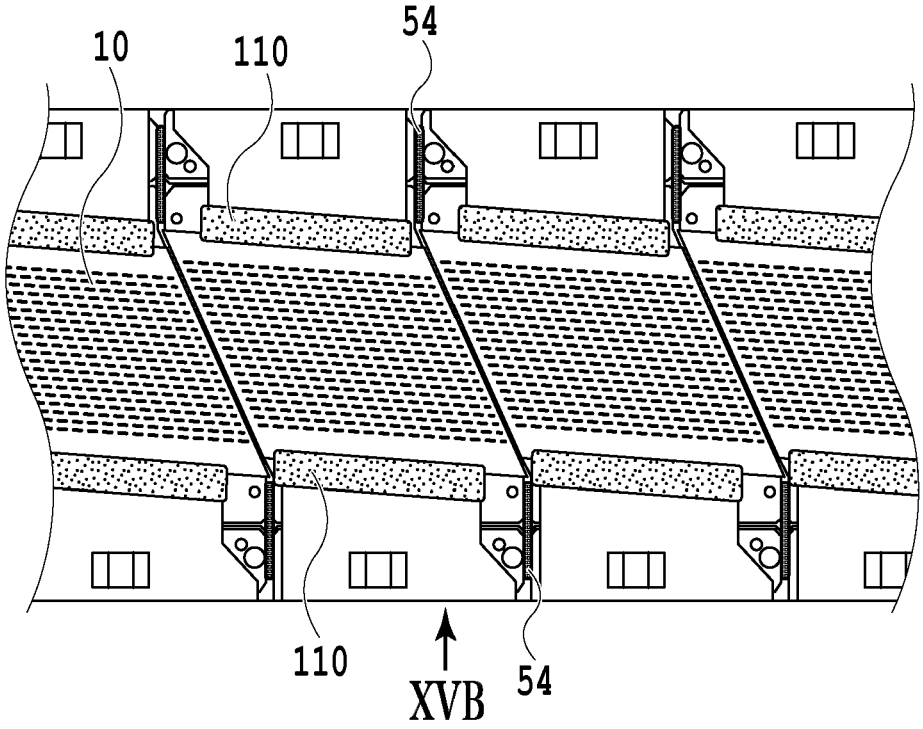
FIG. 15A and FIG. 15B are diagrams to explain a liquid ejection head of the first embodiment of the present invention prior to attachment of a cover member, respectively.
Figure 15B:
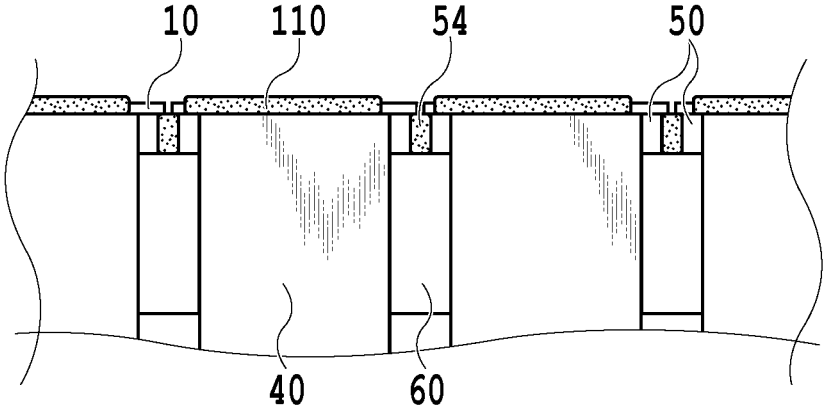
Figure 16A:
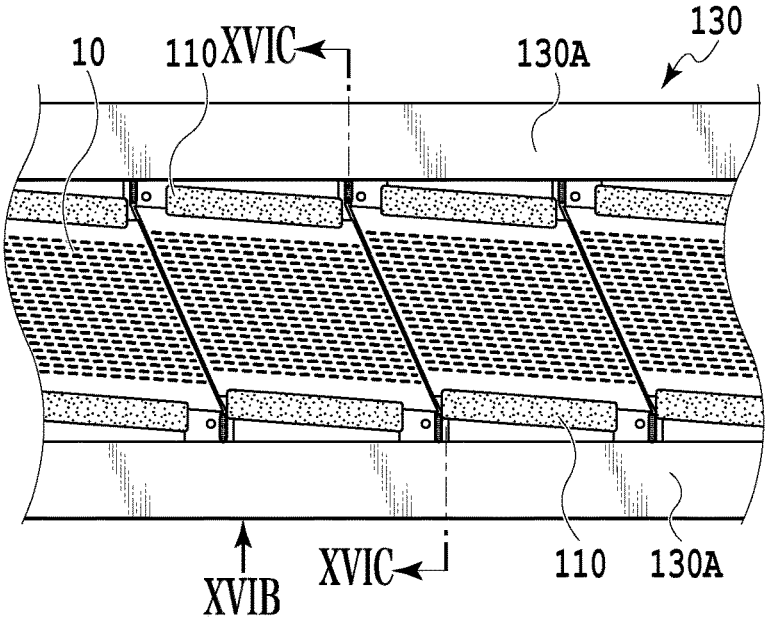
FIG. 16A, FIG. 16B, and FIG. 16C are diagrams to explain the liquid ejection head of the first embodiment of the present invention after the attachment of the cover member, respectively.
Figure 16B:
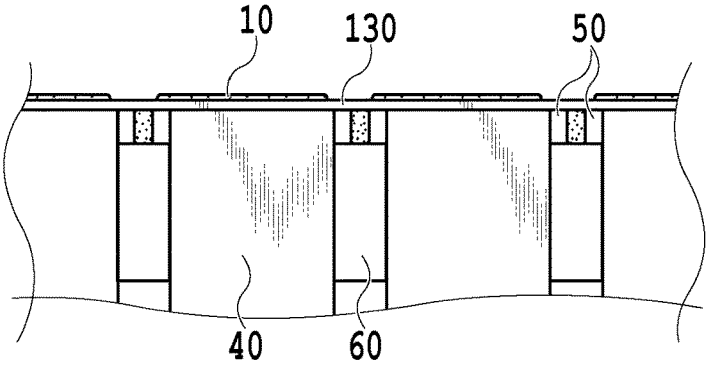
Figure 16C:
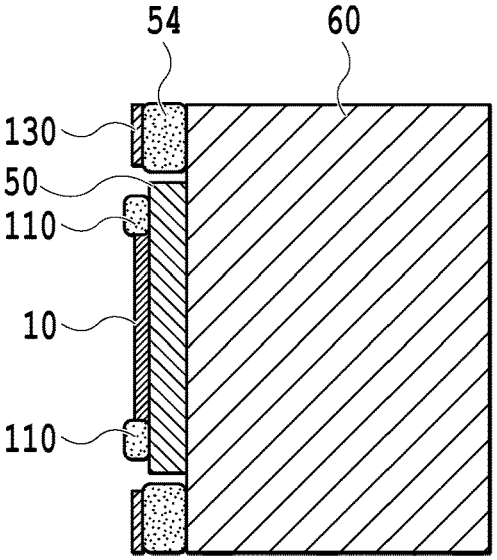
Figure 17A:
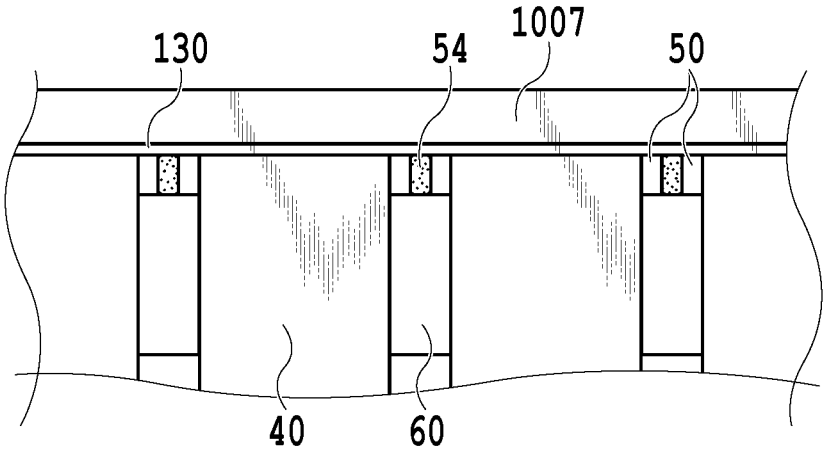
FIG. 17A and FIG. 17B are diagrams to explain the liquid ejection head of the first embodiment of the present invention when a cap member is abutted, respectively.
Figure 17B:
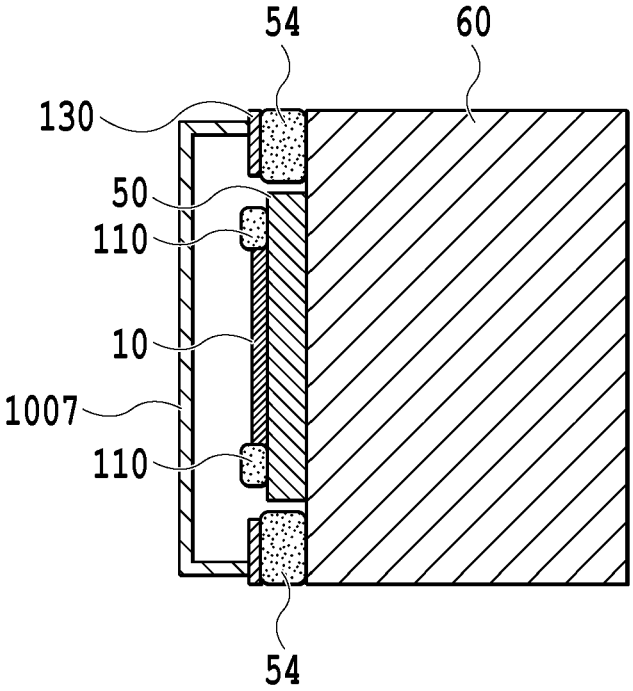

FIG. 15A to FIG. 17B illustrate the first embodiment of the present invention. FIG. 15A is a top view illustrating the liquid ejection head prior to being attached to the cover member 130 in which a portion at which the first flow path members 50 are adjacent to each other in the longitudinal direction of the liquid ejection head is sealed by a sealing member 54. FIG. 15B is an arrow view along a direction XVB of FIG. 15A. FIG. 16A is a top view illustrating the liquid ejection head attached with the cover member 130 after the sealing by the sealing member 54. FIG. 16B is an arrow view along a direction XVIB of FIG. 16A. FIG. 16C is a cross-sectional view taken along a line XVIC-XVIC of FIG. 16A. FIG. 17A is a side view illustrating the liquid ejection head abutted to the cap member 1007. FIG. 17B is a diagram similar to FIG. 16C in which the liquid ejection head is abutted to the cap member 1007.

As shown in FIG. 15A and FIG. 15B, prior to the attachment of the cover member 130 to the liquid ejection head, the sealing member 54 is used to seal a gap existing in the first flow path members 50 adjacent to each other in the longitudinal direction of the liquid ejection head. Thereafter, the cover member 130 is attached to the liquid ejection head as shown in FIG. 16A, FIG. 16B, and FIG. 16C. As shown in FIG. 17A and FIG. 17B, the sealing member 54 seals the gap between the first flow path members 50 and the gap between the cover member 130 and the second flow path member 60. Thus, when the cover member 130 is abutted to the cap member 1007, a sealed space is formed in the cap member 1007. This can consequently suppress, when the interior of the cap member 1007 is sucked, the leakage of the negative pressure in the cap member 1007 to securely perform the ink suction recovery operation.

The sealing member 54 is preferably made of such material that has a high fluidity when the material is coated in order to fill a relatively-narrow region between the first flow path members 50. Furthermore, the sealing member 54 must be coated to have a sufficient height in order to securely seal the space between the cover member 130 and the second flow path member 60. As described above, the ejection module 200 is accurately mounted on the first flow path member 50. Thus, such an accuracy must not be compromised due to the sealing member 54. In the case of a long liquid ejection head such as a line head, when thermal curing sealing agent is used as the sealing member 54, the heat applied for curing the agent has a significant influence on members constituting the liquid ejection head due to the expansion and contraction thereof. In order to suppress the influence on the reliability of the liquid ejection head such as the peeling of a junction due to the influence by the heating for example, the sealing member 54 is preferably made of such material that has a lower elastic modulus than that of adhesive agent used to adhere the first flow path member 50 to the second flow path member 60 and that cures at a normal temperature.

(Second Embodiment)

In the first embodiment, the cap member 1007 abutted to the cover member 130 can avoid the communication of the space in the cap member 1007 with atmospheric air as in the comparison example of FIG. 14B. This can consequently maintain the sealed space of the cap member 1007 to perform a stable recovery operation.

In order to suppress the expansion and contraction of the members constituting the liquid ejection head in a heating step, a sealing member that cures at a normal temperature can be used as the sealing member 54 to thereby avoid the influence by heat during the heating step. However, when all of the regions among a plurality of separate first flow path members 50 are sealed by the sealing member 54, not a little influence is caused by the curing and shrinkage of the sealing member 54 itself. Furthermore, there is a risk where the sealing member 54 is swollen due to the influence by the attachment of ink used in the liquid ejection head and the usage environment. When the sealing member 54 cures, shrinks, or is swollen, the position of the first flow path member 50 may be displaced due to the depression of the first flow path member 50. The displacement may cause a risk where the ejection module is mounted on the first flow path member 50 with a lower position accuracy to thereby consequently cause a deteriorated liquid landing position accuracy.

The second embodiment considers the point as described above. FIG. 18A to FIG. 20B illustrate the second embodiment.

Figure 18A:
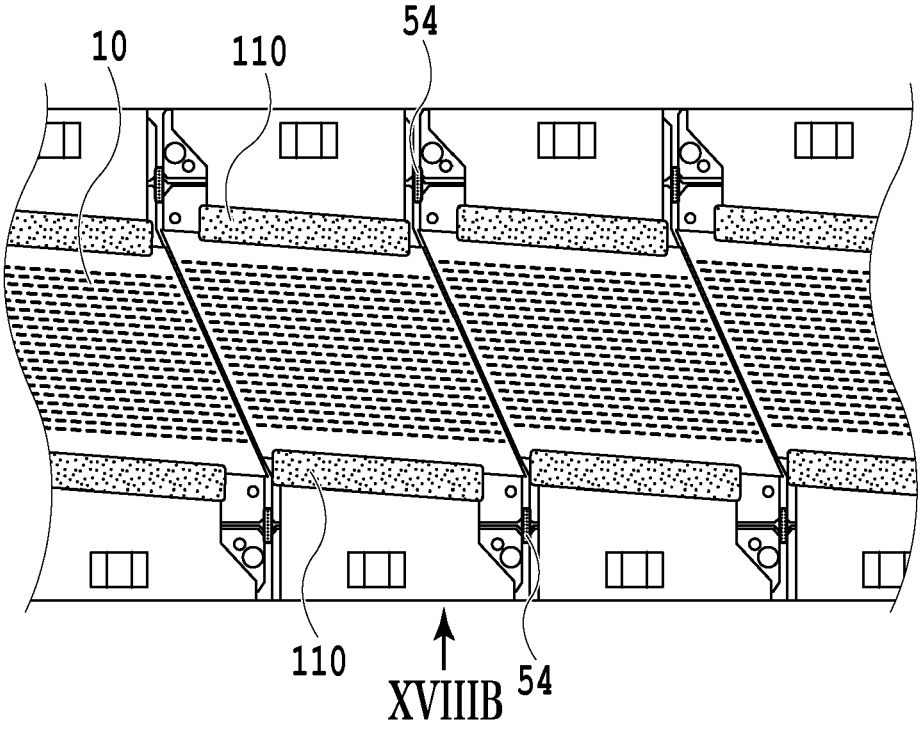
FIG. 18A and FIG. 18B are diagrams to explain a liquid ejection head of the second embodiment of the present invention prior to attachment of a cover member, respectively.
Figure 18B:
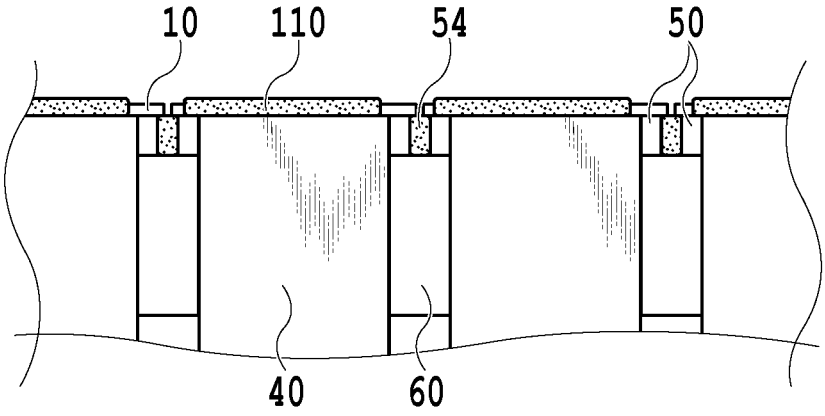
Figure 19A:
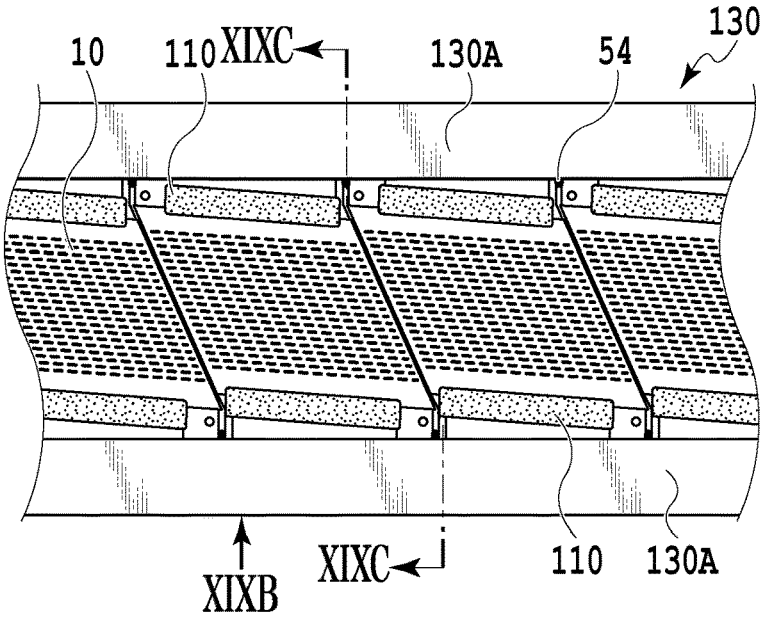
FIG. 19A, FIG. 19B, and FIG. 19C are diagrams to explain the liquid ejection head of the second embodiment of the present invention after the attachment of the cover member, respectively.
Figure 19B:
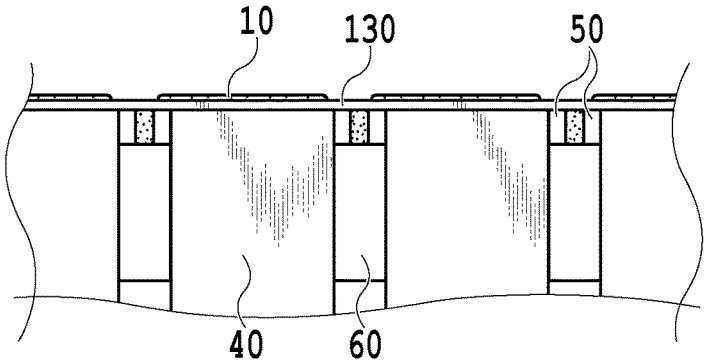
Figure 19C:
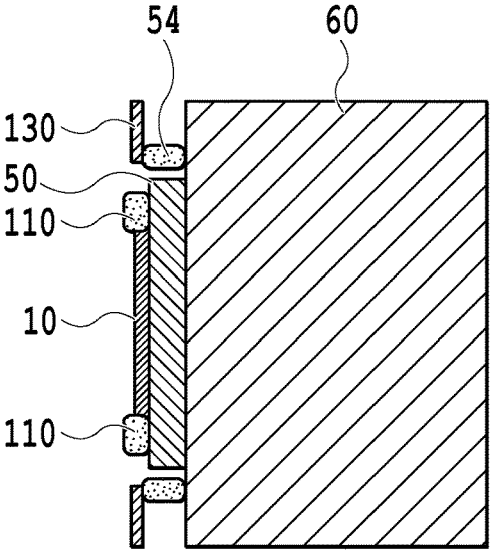
Figure 20A:
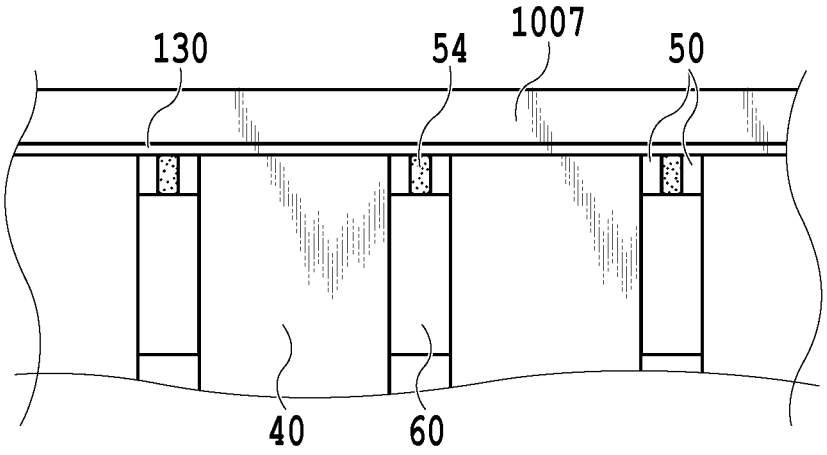
FIG. 20A and FIG. 20B are diagrams to explain the liquid ejection head of the second embodiment of the present invention when a cap member is abutted, respectively.
Figure 20B:
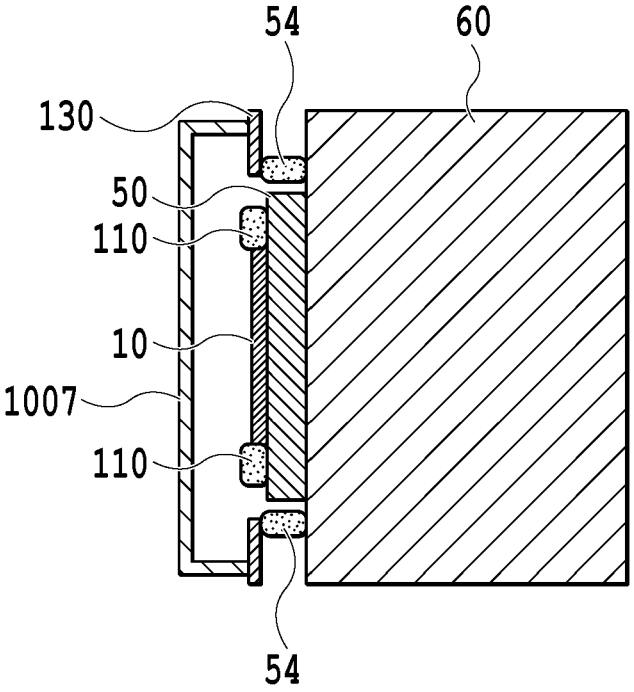

FIG. 18A is a top view illustrating the liquid ejection head in which, prior to the attachment of the cover member 130, the sealing member 54 is used to seal a portion at which the first flow path members 50 are abutted to each other in the longitudinal direction of the liquid ejection head. FIG. 18B is an arrow view along a direction XVIIIB of FIG. 18A. FIG. 19A is a top view illustrating the liquid ejection head when the cover member 130 is attached after the sealing by the sealing member 54. FIG. 19B is an arrow view along a direction XIXB of FIG. 19A. FIG. 19C is a cross-sectional view taken along a line XIXC-XIXC of FIG. 19A. FIG. 20A is a schematic view illustrating ejection head in the longitudinal direction when the cap member 1007 is abutted to the ejection head. FIG. 20B is a diagram similar to FIG. 19C when the cap member 1007 is abutted thereto.

In this embodiment, as shown in FIG. 18A, FIG. 19A, and FIG. 19C, the region sealed by the sealing member 54 is limited to a position at the neighborhood of the opening portion 131 of the cover member 130 (a position close to the opening portion). The sealing by the sealing member 54 is followed by the attachment of the cover member 130 as shown in FIG. 19A. Thereafter, as shown in FIG. 20A and FIG. 20B, the cap member 1007 is abutted to the cover member 130. During this, the sealing member 54 secures the minimum sealed region required for the formation of the sealed space in the cap member 1007. As described above, the minimum required sealing member 54 can be used to form the sealed space in the cap member 1007. This can consequently suppress the influence on the first flow path member 50 by the curing, shrinkage, or swelling of the sealing member 54 to thereby secure the position accuracy of the ejection module and to provide a stable recovery operation. The sealing member 54 in this embodiment requires the secure formation of a sealed space even when the coating region is small. Thus, the sealing member 54 is preferably made of such material that has high thixotropy and that has shape maintenance stability in the coating height direction so that the gap between the first flow path members 50 and the gap between the cover member 130 and the second flow path member 60 can be securely sealed.

Since the ejection module 200 is accurately mounted on the first flow path member 50, this embodiment also must avoid the deterioration of the position accuracy of the ejection module 200 due to the sealing member 54. By limiting the coating region of the sealing member 54 in order to form the sealed space in the cap member 1007, the ejection module 200 can be suppressed from having a deteriorated position accuracy due to the influence by the swelling of the sealing member 54. This embodiment is similar to the first embodiment in that the sealing member 54 is preferably made of such material that has a lower elastic modulus after the curing than that of the adhesive agent used to adhere the first flow path member 50 to the second flow path member 60, and that cures at a normal temperature.

(Third Embodiment)

In the above-described first and second embodiments, prior to the attachment of the cover member 130, the sealing member 54 is used to seal a part of the interior of the cap member 1007 communicating with atmospheric air in the capping status. As described above, the part in which the interior of the cap member 1007 communicates with the atmospheric air is the gap between the first flow path members 50 and the gap between the cover member 130 and the second flow path member 60. Thus, such a gap can be sealed in the first and second embodiments.

On the other hand, there may be a case where variation (physical property variation) is caused in the part accuracy of the plurality of first flow path members 50, the adhesion accuracy thereof, the part accuracies of the cover member 130 and the second flow path member 60, the adhesion accuracy thereof, and the viscosity of each manufacture lot of the sealing member 54, for example. Such a variation causes a risk where a position at which the sealing member 54 is coated causes a different filling amount of the sealing member 54. The variations in various physical properties may be multiplied to cause a risk where, depending on the position at which the sealing member 54 is coated, an insufficient coating amount is applied to thereby cause an insufficient sealing of the interior of the cap member 1007.

The third embodiment considers the point as described above. Specifically, according to the third embodiment, after the attachment of the cover member 130, the sealing member 54 is used to seal an atmospheric air communication portion to thereby cope with the variation in the accuracy of the respective constituent components and the variation in the adhesion accuracy of the respective constituent components. FIG. 21A to FIG. 23D illustrate the third embodiment.

Figure 21A:
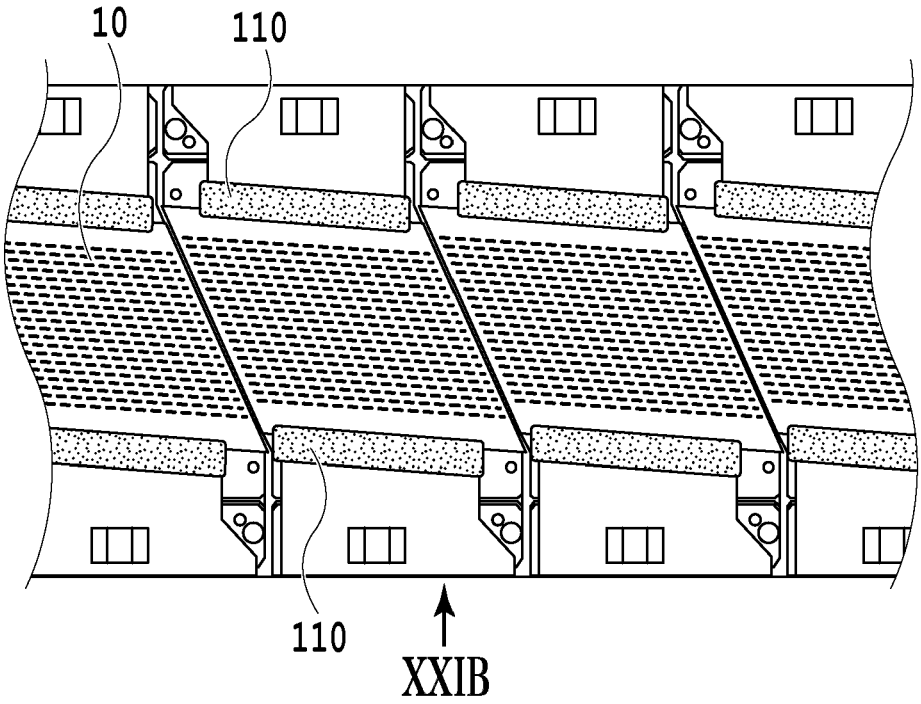
FIG. 21A and FIG. 21B are diagrams to explain a liquid ejection head of the third embodiment of the present invention prior to attachment of a cover member, respectively.
Figure 21B:
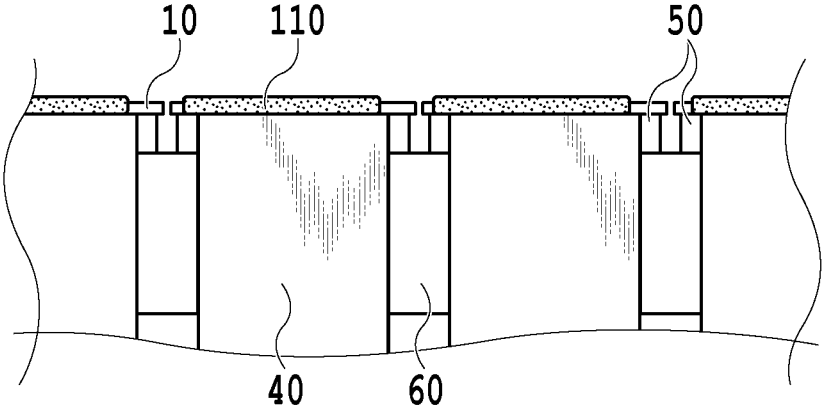
Figure 22A:
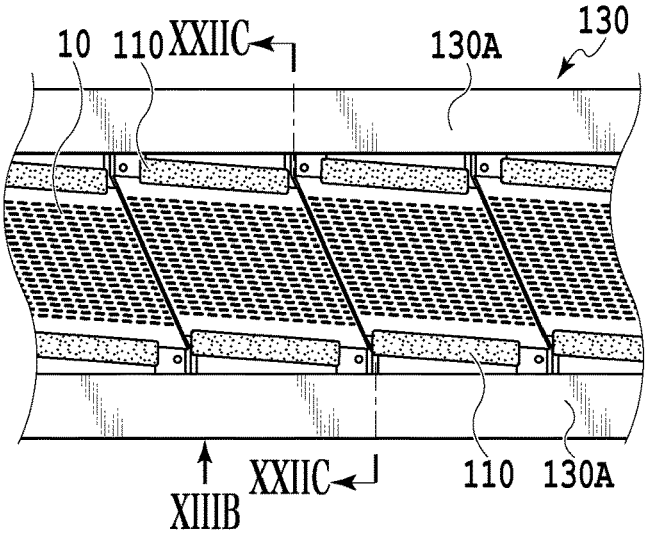
FIG. 22A, FIG. 22B, FIG. 22C, and FIG. 22D are diagrams to explain the liquid ejection head of the third embodiment of the present invention after the attachment of the cover member, respectively.
Figure 22B:
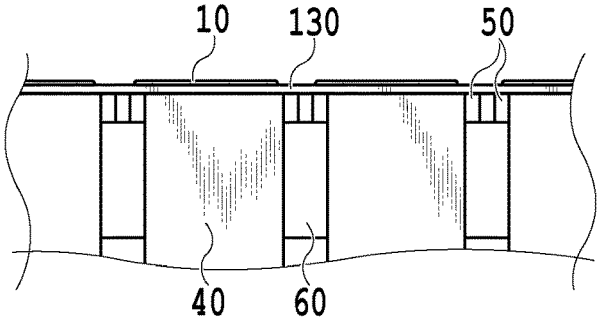
Figure 22C:
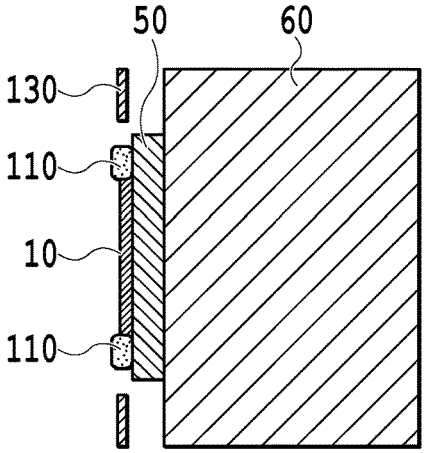

FIG. 21A is a top view illustrating the liquid ejection head prior to being attached with the cover member 130. FIG. 21B is an arrow view along a direction XXIB of FIG. 21A. The first flow path members 50 have thereamong a gap. FIG. 22A is a top view illustrating the liquid ejection head attached with the cover member 130 without being sealed by the sealing member 54. FIG. 22B is an arrow view along a direction XXIIB of FIG. 22A. FIG. 22C is a cross-sectional view taken along a line XXIIC-XXIIC of FIG. 22A. As shown in FIG. 22A and FIG. 22C, a gap is caused between the first flow path members 50 and a gap is caused between the cover member 130 and the second flow path member 60. These gaps exist even when the cover member 130 is abutted to the cap member 1007 as shown in FIG. 22D.

Figure 22D:
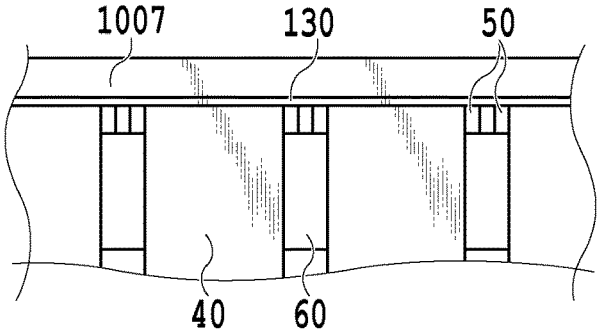
Figure 23A:
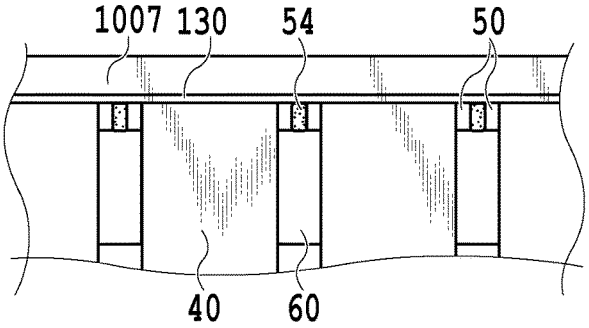
FIG. 23A, FIG. 23B, FIG. 23C, and FIG. 23D are diagrams to explain the liquid ejection head of the third embodiment of the present invention when a cap member is abutted, respectively.
Figure 23B:
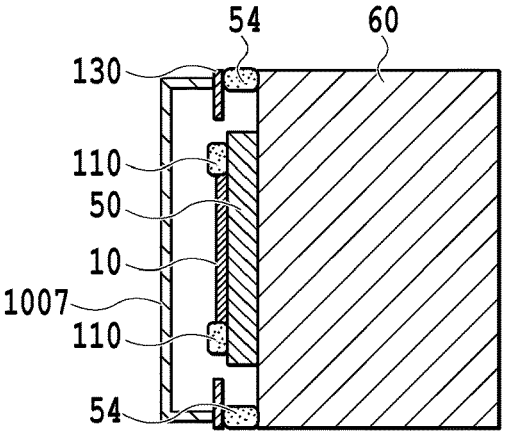
Figure 23C:
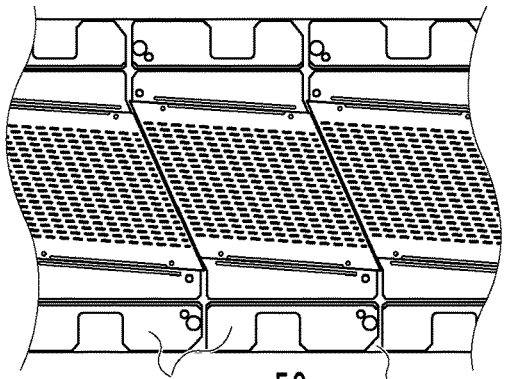
Figure 23D:
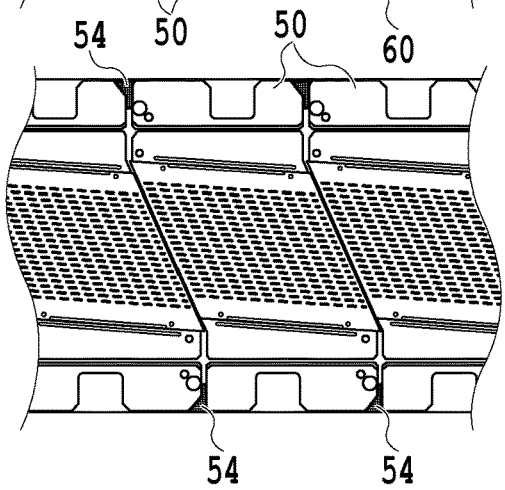

Thus, in this embodiment, as shown in FIG. 23A, at the stage of FIG. 22D, the sealing member 54 is used to seal the gap between the first flow path members 50 and the gap between the cover member 130 and the second flow path member 60. FIG. 23B is a cross-sectional view similar to FIG. 22B after the sealing by the sealing member 54 in which the cap member 1007 is abutted to the cover member 130. A part sealed by the sealing member 54 cannot be visually confirmed from the upper face because of the existence of the cover member 130. Thus, in the top view of the liquid ejection head of FIG. 23C, the cover member 130 is omitted. FIG. 23D is a top view illustrating the liquid ejection head filled with the sealing member 54 in which the cover member 130 is omitted as in FIG. 23C. In this embodiment, as shown in FIG. 23C and FIG. 23D, a corner of the first flow path member 50 corresponding to the region filled with the sealing member 54 is subjected to a chamfering process to thereby partially increase the region filled with the sealing member 54. Specifically, a region in which the sealing member 54 is provided is configured so that the first retention members 50 adjacent to each other have an interval therebetween that is wider at the outer side of the liquid ejection head 3 than at the side of the printing element substrate 10. This can provide an easy filling of the sealing member 54 to thereby provide a more stable filling of the sealing member 54. In addition to such a chamfering process, an optimal shape is preferably selected for the first flow path member 50 in view of various situations such as a manufacture method of a constituent component, the performance required for the constituent component, and a method of filling the sealing member 54.

According to this embodiment, after the adhesion of the cover member 130, the sealing by the sealing member 54 is performed, thereby achieving the sealing depending on the adhesion accuracy and part accuracy of the respective constituent components. The interior of the cap member 1007 does not include a closed space, so the subsequent addition of the sealing member 54 (i.e., repair) is possible.

The sealing member 54 in this embodiment must be able to form a sealed space even when the sealing member 54 is coated within a small region. Thus, the sealing member 54 is preferably made of material that has high thixotropy and that has shape maintenance stability in the coating height direction so that the gap between the first flow path members 50 and the gap between the cover member 130 and the second flow path member 60 can be securely sealed. Since the ejection module 200 is accurately mounted on the first flow path member 50, this embodiment also must avoid the deterioration of the position accuracy of the ejection module 200 due to the sealing member 54. Thus, as in the above-described embodiments, the sealing member 54 has preferably an elastic modulus higher than that of the adhesive agent for causing the first flow path member 50 to adhere to the second flow path member 60, and that cures at a normal temperature.

(Other Embodiments)

The present invention can be widely applied as a liquid ejection head, a liquid ejection apparatus, and a liquid ejection head manufacture method by which various liquids can be ejected. The present invention also can be applied to a liquid ejection apparatus to use a liquid ejection head that can eject liquid ink to subject various media (sheet) to various processings (e.g., printing, processing, coating, and irradiation). The medium (including a printing medium) includes various media of any materials to which liquid including ink is applied such as paper, plastic, film, fabric, metal, or a flexible substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-106292 filed May 27, 2016, which is hereby incorporated by reference herein in its entirety.

What is claimed is:

1. A liquid ejection head, comprising:

a plurality of element substrates each configured to include an ejection opening face on which an ejection opening is formed and an element for ejecting ink through the ejection opening;

a plurality of first retention members configured to retain the element substrates;

a second retention member configured to retain the plurality of first retention members;

a cover member configured to be provided on an upper side of the first retention members so as to extend along a first direction along which the plurality of first retention members are arranged, the cover member including a face on which a cap member covering the ejection opening face is abutted; and a sealing member disposed in a space surrounded by the plurality of first retention members, the second retention member, and the cover member, wherein the sealing member contacts with opposed portions of the first retention members that are adjacent to each other in the first direction to seal between the opposed portions of the first retention members that are adjacent to each other, the opposed portions of the first retention members that are adjacent to each other opposing one another.

2. The liquid ejection head of claim 1, wherein:

the plurality of first retention members are a plurality of first flow path members including therein liquid flow paths, respectively, and the second retention member is a second flow path member including therein a liquid flow path.

3. The liquid ejection head of claim 1, wherein:

the cover member includes an opening portion to expose the ejection opening faces of the plurality of element substrates; and the sealing member seals between the first retention members that are adjacent to each other at a part positioned near the opening portion.

4. The liquid ejection head of claim 1, wherein:

the first retention members and the second retention member are joined by an adhesive agent, and the sealing member has an elastic modulus after curing that is lower than that of the adhesive agent.

5. The liquid ejection head of claim 1, wherein:

the sealing member cures at a normal temperature.

6. The liquid ejection head of claim 1, wherein:

the element substrate includes a pressure room including therein the element, and liquid in the pressure room is circulated between the pressure room and the outer side of the pressure room.

7. The liquid ejection head of claim 1, wherein:

in a region in which the sealing member is provided, the first retention members that are adjacent to each other have therebetween an interval that is wider at an outer side of the liquid ejection head than at the element substrate side.

8. The liquid ejection head of claim 1, wherein the sealing member seals between end portions, in a second direction crossing the first direction, of the first retention members adjacent to each other in the first direction.

9. The liquid ejection head of claim 1, wherein an end portion, in the first direction, of the element substrate is in a position projected from the first retention member in the first direction.

10. The liquid ejection head of claim 1, wherein the element substrate has a side extending in a direction diagonally crossing the first direction in a plan view, and the element substrates adjacent to each other in the first direction are arranged so that the sides of the element substrates adjacent to each other are close to each other.

11. The liquid ejection head of claim 1, wherein the liquid ejection head is a line-type head.

12. The liquid ejection head of claim 11, wherein the element substrates are arranged on a straight line.

13. The liquid ejection head of claim 1, wherein the sealing member seals the space.

14. The liquid ejection head of claim 1, further comprising:

a plurality of support members disposed between the element substrates and the first retention members to support the element substrates.

15. The liquid ejection head of claim 1, wherein:

the opposed portions are positioned on surfaces of the first retention members that are adjacent to each other, the surfaces being different from surfaces of the first retention members on which the element substrates are retained.

16. A liquid ejection apparatus, comprising:

a liquid ejection head; and a cap member, wherein the liquid ejection head comprises:

a plurality of element substrates each configured to include an ejection opening face on which an ejection opening is formed and an element for ejecting ink through the ejection opening;

a plurality of first retention members configured to retain the element substrates;

a second retention member configured to retain the plurality of first retention members;

a cover member configured to be provided on an upper side of the first retention members so as to extend along a first direction along which the plurality of first retention members are arranged, the cover member including a face on which the cap member covering the ejection opening face is abutted; and a sealing member disposed in a space surrounded by the plurality of first retention members, the second retention member, and the cover member, wherein the sealing member contacts with opposed portions of the first retention members that are adjacent to each other in the first direction to seal between the opposed portions of the first retention members that are adjacent to each other, the opposed portions of the first retention members that are adjacent to each other opposing one another.

17. A method of manufacturing a liquid ejection head, the liquid ejection head comprising a plurality of element substrates each configured to include an ejection opening face on which an ejection opening is formed and an element for ejecting ink through the ejection opening, a plurality of first retention members configured to retain the element substrates, a second retention member configured to retain the plurality of first retention members, a cover member configured to be provided on an upper side of the first retention members so as to extend along a first direction along which the plurality of first retention members are arranged, the cover member including a face on which a cap member covering the ejection opening face is abutted, and a sealing member disposed in a space surrounded by the plurality of first retention members, the second retention member, and the cover member, wherein the sealing member contacts with opposed portions of the first retention members that are adjacent to each other in the first direction to seal between the opposed portions of the first retention members that are adjacent to each other, the opposed portions of the first retention members that are adjacent to each other opposing one another, the method comprising:

a step of retaining the element substrates on the first retention members;

a step of retaining the first retention members on the second retention member;

a step of sealing between the first retention members adjacent to each other by the sealing member; and a step of attaching the cover member on an upper side of the first retention members after the step of sealing.

* * * * *